US006736090B1

(12) United States Patent
Ichikawa

(10) Patent No.: US 6,736,090 B1
(45) Date of Patent: May 18, 2004

(54) VALVE DEVICE OF ENGINE

(76) Inventor: Masaharu Ichikawa, 4-11, Matsubara 1-chome, Setagaya-ku, Tokyo 156-0043 (JP)

( * ) Notice: Subject to any disclaimer, the term of this patent is extended or adjusted under 35 U.S.C. 154(b) by 0 days.

(21) Appl. No.: 09/980,519

(22) PCT Filed: May 24, 1999

(86) PCT No.: PCT/JP99/02735

§ 371 (c)(1),
(2), (4) Date: Aug. 27, 2002

(87) PCT Pub. No.: WO00/71859

PCT Pub. Date: Nov. 30, 2000

(51) Int. Cl.[7] ..... F02B 75/02; F02N 3/00

(52) U.S. Cl. ..... 123/65 A; 123/65 VB; 123/81 C; 123/188.4; 123/188.5

(58) Field of Search ..... 123/188.1, 188.4, 123/188.5, 65 A, 65 VB, 81 C

(56) References Cited

U.S. PATENT DOCUMENTS 5,209,192 A * 5/1993 Ahmed et al. ..... 123/65 PE

FOREIGN PATENT DOCUMENTS

| | | | |
|---|---|---|---|
| JP | 57-105501 | * 7/1982 | |
| JP | 63-201456 | * 8/1988 | |
| JP | 01-313608 | 12/1989 | ..... F01L/5/06 |
| JP | 2-67047 | * 5/1990 | |
| JP | 10-325320 | * 12/1998 | |

* cited by examiner

*Primary Examiner*—Noah P. Kamen
(74) *Attorney, Agent, or Firm*—Chapman and Cutler LLP

(57) ABSTRACT

An engine valve device, wherein an opening part (7) smaller in area than the end surface of a piston (5) is provided in the end surface of a cylinder (3) to form a valve seat (8), and a valve disc (9) in contact with the valve seat (8) is disposed on the outerside of the valve seat (8) so that the cylinder (3) can be moved away from and toward the valve disc (9) and, in a compression stroke when the piston (5) rises, the valve seat (8) is in press-contact with the fixed valve disc (9) because upward force is applied to the upper end surface of the cylinder (3) and the cylinder (3) is urged toward the valve disc, and the area of the opening part is increasable up to the ultimate diameter of the piston, providing a highly airtight, simple-structured valve device yielding high engine energy efficiency.

13 Claims, 36 Drawing Sheets

VALVE DEVICE OF ENGINE

TECHNICAL FIELD

The present invention relates to a valve device for use in suction/exhaust of a cylinder in an engine or an external combustion engine and a pump.

BACKGROUND OF THE INVENTION

Conventional engines use a bevel valve, called a mushroom valve, as a valve for suction/exhaust of the cylinder, and, to establish timing between the rising/lowering movement of the piston and the opening/closing of the valve, interlocking the two elements with each other by means of gears, chains or cams.

The mushroom valve has a small valve opening area and is incapable of increasing the opening area in terms of its structure, so that when it is desired to improve the suction/exhaust efficiency to enable high-speed rotations, a plurality of mushroom valves needs to be provided, resulting in a complicated interlocking mechanism with the piston.

Additionally, in case of the valve device such as the mushroom valve for use in the conventional engine, the internal pressure acting on the valve disc is determined only by the area of the valve (the opening area of the valve seat, or the total area thereof when a plurality of valves are provided) irrespective of the cylinder diameter. For this reason, an increase in the valve area to improve the exhaust efficiency may induce an increase in the energy loss from opening the valve.

The crankcase compression type two-cycle engine makes use of the crankcase for scavenging, and hence has a poor scavenging efficiency, and requires mixing of a lubricant into fuel. This makes it difficult to solve the exhaust gas problems.

It is therefore a first object of the present invention to allow the suction/exhaust valve of the cylinder to be linked with motion of the piston without using any additional interlocking mechanism such as gears.

A second object of the present invention is to increase the valve area while minimizing the energy loss from opening the valve, to thereby enhance the intake/discharge efficiency for efficient operation.

A third object of the present invention is not to use the crankcase for scavenging, even in two-cycle engines, thereby eliminating the need to mix the lubricant and fuel, to obtain an improved exhaust gas.

DESCRIPTION OF THE INVENTION

A first embodiment of the invention provides an engine, having a valve device, the valve device comprising a cylinder into which a fluid is supplied, a piston mounted in the cylinder, and a valve for providing switching between suction and exhaust of a pressure fluid to and from the cylinder. The valve device comprises a valve seat defined by an opening for fluid inflow formed in an end face of the cylinder, the opening being smaller in area than the end face of the piston; and a valve disc arranged outside of the valve seat, the valve disc coming into abutment against the valve seat; wherein the cylinder is moveable in the axial direction, the end face of the cylinder capable of coming into or out of contact with the valve disc, wherein when the interior of the cylinder is pressurized as a result of abutment of the valve seat against the valve disc, the end face of the cylinder is urged toward the valve disc so that the valve seat and the valve disc are brought into press-contact with each other, and wherein the movement of the cylinder is controlled by the movement of the piston.

An engine, having a valve device, is configured such that the cylinder includes an upper cylinder and a lower cylinder, the upper cylinder being urged downward, the lower cylinder being urged upward, the lower cylinder having at its lower end a raised portion against which the lower end of the piston abuts, that when the piston rises, the lower cylinder also rises and thrusts up the upper cylinder to close the valve seat so that the valve seat comes into press-contact with the valve disc when the interior of the cylinder is pressurized, and that when the piston falls, the lower cylinder is disengaged from the upper cylinder so that an outlet is formed between the upper cylinder and the lower cylinder and that the valve seat is opened to form an opening.

It is to be noted that the engine intended for the present invention can include a pump, as well as the internal combustion engine and the external combustion engine.

The end face of the cylinder may be provided by an ordinary cylinder having an end face integrated with the cylinder body, or the cylinder can be of a type including a cylinder end face element that is fitted to an end portion of the cylinder body in such a manner that the cylinder end face element is movable along the central axis of the cylinder.

A second embodiment of the invention provides an engine, having a valve device, the valve device comprising a cylinder to which a fluid is supplied, a piston mounted in the cylinder, and a valve for providing switching between suction and exhaust of a pressure fluid to and from the cylinder, the valve device comprising a valve seat defined by an opening for fluid inflow formed in an end face of the cylinder, the opening being smaller in area than the end face of the piston; and a valve disc arranged outside of the valve seat, the valve disc coming into abutment against the valve seat, wherein the cylinder is movable in its axial direction, the end face of the cylinder capable of coming into or out of contact with the valve disc, wherein when the interior of the cylinder is pressurized as a result of abutment of the valve seat against the valve disc, the end face of the cylinder is urged toward the valve disc so that the valve seat and the valve disc are brought into press-contact with each other, and wherein the movement of the cylinder is controlled by the movement of the piston.

An engine, having a valve device, is configured such that above the cylinder are formed an inlet and an outlet, the inlet and the outlet each having a check valve, that the piston is urged upward by a piston spring, that the cylinder is urged upward by a cylinder spring, that the cylinder is provided at its lower end with a lock pin capable of being engaged with or disengaged from the cylinder for locking or unlocking the cylinder, the lock pin being controlled by an interlocking mechanism so as to come into or out of contact with the cylinder depending on the rotation of a crank, that the check valve of the outlet above the cylinder is opened for exhaust when the piston rises with the lock pin engaged with the cylinder, the check valve of the inlet being opened for introduction of new air when the piston falls with the lock pin engaged with the cylinder, and that combustion gas is emitted from the outlet above the cylinder when the piston falls with the lock pin disengaged from the cylinder.

A third embodiment of the invention provides an engine, having a valve device, the valve device comprising a cylinder into which a fluid is supplied, a piston mounted in the cylinder, and a valve for providing switching between suction and exhaust of a pressure fluid to and from the cylinder, the valve device comprising a valve seat defined by an opening for fluid inflow formed in an end face of the cylinder, the opening being smaller in area than the end face of the piston; and a valve disc arranged outside of the valve seat, the valve disc coming into abutment against the valve seat, wherein the cylinder is movable in its axial direction, the end face of the cylinder capable of coming into or out of contact with the valve disc, wherein when the interior of the cylinder is pressurized as a result of abutment of the valve seat against the valve disc, the end face of the cylinder is urged toward the valve disc so that the valve seat and the valve disc are brought into press-contact with each other, wherein the movement of the cylinder is controlled by the movement of the piston.

An engine, having a valve device, is configured such that the cylinder is urged upward by a cylinder spring, the cylinder having at its lower end a raised portion against which the lower end of the piston abuts, that a rotary valve is disposed between an inlet and an outlet above the cylinder, and that the rotary valve acts to provide a control such that both the inlet and the outlet are closed when the piston is at or in vicinity of its bottom dead center in a first cycle, the outlet being opened when the piston rises, the inlet being opened when the piston falls, and such that both the inlet and the outlet are closed all the time in a second cycle so that gas is emitted from an opening of the cylinder when the piston falls after ignition.

A fourth embodiment of the invention provides an engine, having a valve device, the valve device comprising a cylinder into which a fluid is supplied, a piston mounted in the cylinder, and a valve for providing switching between suction and exhaust of a pressure fluid to and from the cylinder, the valve device comprising a valve seat defined by an opening for fluid inflow formed in an end face of the cylinder, the opening being smaller in area than the end face of the piston; and a valve disc arranged outside of the valve seat, the valve disc coming into abutment against the valve seat, wherein the cylinder is movable in its axial direction, the end face of the cylinder capable of coming into or out of contact with the valve disc, wherein when the interior of the cylinder is pressurized as a result of abutment of the valve seat against the valve disc, the end face of the cylinder is urged toward the valve disc so that the valve seat and the valve disc are brought into press-contact with each other, and wherein the movement of the cylinder is controlled by the movement of the piston.

An engine, having a valve device, is configured such that above the cylinder are formed an inlet and an outlet, the inlet and the outlet each having a check valve, with an outlet for combustion gas being disposed below the outlet, the outlet for combustion gas being provided with a switching valve having an annular disc, that the switching valve is freely capable of rise and fall and is urged downward by a valve spring so as to come into abutment against the upper end of the cylinder, the switching valve closing the outlet for combustion gas when the switching valve falls, the switching valve closing the outlet above the cylinder when the switching valve rises, that the cylinder is provided with a lock pin capable of being engaged with or disengaged from the cylinder for locking or unlocking the cylinder, that in a first cycle, the cylinder is locked at its lower position by the lock pin, with the switching valve being pressed downward to close the outlet for combustion gas, and that in a second cycle, the cylinder is released from locking by the lock pint, with the switching valve being thrust upward by the pressure of the combustion gas when the piston falls after ignition so that the outlet for combustion gas is opened to emit combustion gas therethrough.

A fifth embodiment of the invention provides an engine, having a valve device, the valve device comprising a cylinder into which a fluid is supplied, a piston mounted in the cylinder, and a valve for providing switching between suction and exhaust of a pressure fluid to and from the cylinder, the valve device comprising a valve seat defined by an opening for fluid inflow formed in an end face of the cylinder, the opening being smaller in area than the end face of the piston; and a valve disc arranged outside of the valve seat, the valve disc coming into abutment against the valve seat, wherein the cylinder is movable in its axial direction, the end face of the cylinder capable of coming into or out of contact with the valve disc, wherein when the interior of the cylinder is pressurized as a result of abutment of the valve seat against the valve disc, the end face of the cylinder is urged toward the valve disc so that the valve seat and the valve disc are brought into press-contact with each other, and wherein the movement of the cylinder is controlled by the movement of the piston.

An engine, having a valve device, is configured such that above the cylinder are formed an inlet and an outlet, that the outlet is positioned such that the outlet is closed by the cylinder when the cylinder rises and that the outlet is opened when the cylinder falls, that an intermediate valve is disposed in such a manner as to be able to freely rise and fall between the cylinder and the valve disc, the intermediate valve having a bottom face coming into abutment against the valve seat of the cylinder and having a top face coming into abutment against the valve disc, the intermediate valve being urged downward by a valve spring, that when the piston is at its bottom dead center, an inlet flow passage is formed between the top face of the intermediate valve and the valve disc whilst an outlet flow passage is formed between the intermediate valve and the valve seat so that the interior of the cylinder is scavenged, that when the piston rises, the cylinder rises together with the rise of the piston and the intermediate valve comes into abutment against the valve seat to shut off fluid communication between a cylinder opening and the outlet to allow only inflow to continue, that when the cylinder further rises, the intermediate valve comes into abutment against the valve disc to close the cylinder opening, and that when the piston falls after combustion, the intermediate valve is thrust up by the pressure of combustion gas and the outlet flow passage is opened to emit combustion gas therethrough.

A sixth embodiment of the invention provides an engine, having a valve device, the valve device comprising a cylinder into which a fluid is supplied, a piston mounted in the cylinder, and a valve for providing switching between suction and exhaust of a pressure fluid to and from the cylinder, the valve device comprising a valve seat defined by an opening for fluid inflow formed in an end face of the cylinder, the opening being smaller in area than the end face of the piston; and a valve disc arranged outside of the valve seat, wherein an auxiliary valve disc is disposed in such a manner as to be able to freely rise and fall between an upper end face of the cylinder and the valve disc. The cylinder is movable in its axial direction, with the end face of the cylinder capable of coming into or out of contact with the auxiliary valve disc, wherein when the interior of the cylinder is pressurized as a result of abutment of the auxiliary valve disc against the valve seat and the valve disc, the end face of the cylinder is urged toward the valve disc so that the auxiliary valve disc is brought into press-contact with the valve seat and the valve disc, and wherein the movement of the cylinder is controlled by the movement of the piston.

An engine, having a valve device, is configured such that the engine body is provided with a seat for the auxiliary valve seat, that an inlet passage for thick gas mixture is disposed above the auxiliary valve disc, with an inlet passage for thin gas mixture being disposed below the auxiliary valve disc, that the auxiliary valve disc is provided with a vent for allowing the inlet passage for thick gas mixture to fluidly communicate with a cylinder opening, and that as a result of rise of the cylinder, the valve seat of the cylinder comes into abutment against and thrusts up the auxiliary valve disc so that the top face of the auxiliary valve disc is abutted against the valve disc so that the cylinder opening is closed to hermetically seal the interior of the cylinder.

A seventh embodiment of the invention provides an engine, having a valve device, according to any one of the previous six embodiments, wherein the valve disc is provided with a fuel injection nozzle and/or an igniter.

An eight embodiment of the invention provides an engine, having a valve device, the valve device comprising a cylinder into which a fluid is supplied, a piston mounted in the cylinder, and a valve for providing switching between suction and exhaust of a pressure fluid to and from the cylinder, the valve device comprising a valve seat defined by an opening for fluid inflow formed in an end face of the cylinder, the opening being smaller in area than the end face of the piston; and a valve disc arranged outside of the valve seat, the valve disc coming into abutment against the valve seat, wherein the cylinder is movable in its axial direction, the end face of the cylinder capable of coming into or out of contact with the valve disc, wherein when the interior of the cylinder is pressurized as a result of abutment of the valve seat against the valve disc, the end face of the cylinder is urged toward the valve disc so that the valve seat and the valve disc are brought into press-contact with each other, and wherein the movement of the cylinder is controlled by the movement of the piston.

An engine, having a valve device, is configured such that a cap of the engine body includes an inlet for pressure fluid, with between the inlet for pressure fluid and the valve seat of the cylinder there being provided, in such a manner as to be able to rise and fall, a valve disc for opening and closing a cylinder opening and a spherical auxiliary valve disc moving in conjugation with movement of the valve disc for opening and closing the inlet, that the cylinder and the valve disc are urged downward by respective springs, that the valve disc is provided with a communication passage for providing a communication between upper and lower portions so that when the valve disc rises, the auxiliary valve disc is thrust up by a protrusion to open the valve, that when the cylinder falls, the cylinder opening is opened to exhaust the interior of the cylinder of fluid whilst the valve seat at the inlet for pressure fluid is closed by the auxiliary valve disc, and that when the valve seat of the cylinder abuts against the valve disc, the opening is closed and the auxiliary valve disc is thrust up by the protrusion to open the inlet for pressure fluid so that the pressure fluid flows through the communication passage of the valve disc into the interior of the cylinder so that the piston is pressed down.

A ninth embodiment of the invention provides an engine, having a valve device, the valve device comprising a cylinder into which a fluid is supplied, a piston mounted in the cylinder, and a valve for providing switching between suction and exhaust of a pressure fluid to and from the cylinder, the valve device comprising a valve seat defined by an opening for fluid inflow formed in an end face of the cylinder, the opening being smaller in area than the end face of the piston; and a valve disc arranged outside of the valve seat, the valve disc coming into abutment against the valve seat, wherein the cylinder is movable in its axial direction, the end face of the cylinder capable of coming into or out of contact with the valve disc, wherein when the interior of the cylinder is pressurized as a result of abutment of the valve seat against the valve disc, the end face of the cylinder is urged toward the valve disc so that the valve seat and the valve disc are brought into press-contact with each other, and wherein the movement of the cylinder is controlled by the movement of the piston.

An engine, having a valve device, is configured such that a pump chamber is formed between an inner wall of an engine body and an outer wall of the cylinder capable of freely rising and falling, by differentiating in diameter the upper portion from the lower portion of the inner wall of the engine body via a shoulder and by differentiating in diameter the upper portion from the lower portion of the outer wall of the cylinder via a shoulder, that the pump chamber is placed in communication with a heater and a cooler, the heater leading to the upper portion of the cylinder, that between the inlet to the cylinder of the heater and the cylinder is disposed a valve disc for opening and closing a flow passage extending between the inlet and the cylinder by rise and fall of the piston, that the valve disc is in the shape of a tube with its upper portion having an opening which leads to the inlet, the valve disc being urged downward, that when the piston is at its top dead center, the valve disc is thrust up to allow the inlet and the valve disc opening to communicate with each other to open the flow passage whilst the valve disk opening and the outlet are closed to allow heated fluid to flow into the cylinder so that the piston is pressed down with the cylinder falling, and that when the cylinder falls, communication between the inlet and the cylinder is shut off and the cylinder is placed in communication-with the cooler by way of the outlet whilst the pump chamber is reduced in volume to allow fluid within the pump chamber to flow into the heater.

A tenth embodiment of the invention provides an engine, having a valve device, according to any one of the first through the fifth embodiments, wherein the cylinder is urged toward the valve disc, the cylinder being provided at its lower portion with a raised portion against which the lower end of the piston abuts, with a lower side wall of the cylinder having an outlet which opens when the piston falls, wherein between the piston and the lower portion of the cylinder is disposed a piston spring for urging the piston upward so that the piston closes the outlet when the piston spring has been fully extended, and wherein when the interior of the cylinder is pressurized as a result of rise of the piston, the valve seat comes into press-contact with the valve disc, whilst when the piston falls, the outlet is opened and the cylinder falls as a result of pressing by the piston so that the valve seat is disengaged from the valve disc.

An eleventh embodiment of the invention provides an engine, having a valve device, the valve device comprising a cylinder into which a fluid is supplied, a piston mounted in the cylinder, and a valve for providing switching between suction and exhaust of a pressure fluid to and from the cylinder, the valve device comprising a valve seat defined by an opening for fluid inflow formed in an end face of the cylinder, the opening being smaller in area than the end face of the piston; and a valve disc arranged outside of the valve seat, the valve disc coming into abutment against the valve seat, wherein the cylinder is movable in its axial direction, the end face of the cylinder capable of coming into or out of contact with the valve disc, wherein when the interior of the cylinder is pressurized as a result of abutment of the valve seat against the valve disc, the end face-of the cylinder is urged toward the valve disc so that the valve seat and the valve disc are brought into press-contact with each other, wherein the movement of the cylinder is controlled by the movement of the piston, wherein the cylinder consists of a cylinder body in the shape of a tube, and a cylinder end face element having an opening and a valve seat, the cylinder end face element being fitted to the upper end of the cylinder body in such a manner as to be able to rise and fall, wherein the cylinder body is firmly secured to the engine body, with the cylinder end face element being fitted to the cylinder body in an air-tight manner, the cylinder end face element being coupled to an actuator via a rod, and wherein the actuator is urged upward by a spring so that when the piston falls, the actuator falls as a result of pressing of the piston and that when the piston rises, the actuator rises by a biasing force of the spring.

The basic functions of the present invention will be described with reference to FIGS. 1 to 7 showing an application to the two-cycle engine.

As seen in FIG. 1, an engine 1 comprises a cylinder 3 positioned above a crankcase 2 in such a manner as to be able to rise and fall. The cylinder 3 is urged upward by a cylinder spring 4, with a piston 5 mounted within the cylinder 3. In the diagram, reference numeral 6 denotes a crank.

The cylinder 3 has in its upper end face an opening 7 for fluid inflow whose periphery defines a valve seat 8. Above the valve seat 8 is disposed a valve disc 9 that comes into abutment against the valve seat 8 when the cylinder 3 is in its rising stroke.

Between the upper end face of the cylinder 3 and the valve disc 9 is formed an inlet passage 10 which opens when the cylinder 3 is in its lowering stroke. The inlet passage 10 leads to the crankcase 2 by way of an inflow pipe 11 such that fresh air sucked from the inlet 12 of the crankcase 2 is supplied via the inlet passage 10 to the cylinder 3.

Reference numeral 13 denotes an outlet disposed at the lower portion of the cylinder 3.

FIG. 2 shows the state where the piston 5 is at its bottom dead center (0-degree crank angle). In this state, the lower end of the piston 5 abuts against a raised portion 14 formed on the lower end of the cylinder 3, and the cylinder 3 is pressed and moved downward by the piston 5. As a result, the valve seat 8 is disengaged from the valve disc 9 to allow fresh air to flow through the inlet passage 10 into the cylinder 3. Since the outlet 13 is also opened at that time, the residual gas within the cylinder is exhausted so that the interior of the cylinder 3 is filled with fresh air.

FIG. 3 shows the state of 60-degree crank angle, in which, attendant on the rise of the piston, the cylinder 3 rises by the spring force of the cylinder spring 4, and the valve seat 8 abuts against the valve seat 9 to close the opening 7, with the outlet 13 remaining opened.

FIG. 4 shows the state of 85-degree crank angle, in which the outlet 13 is closed by the piston so that the interior of the cylinder enters into the compression stroke.

In this compression stroke, the press-contact force between the valve seat 8 and the valve disc 9 will go up as the compression increases. Because the cylinder 3 is able to rise and fall, an upward force will act on the upper end face of the cylinder when the piston rises. Thus, the valve seat 8 comes into press-contact with the fixed valve disc 9.

For this reason, even though the opening 7 has a large area, any leakage of the fluid compressed within the cylinder can be prevented by means of a simple valve structure.

FIG. 5 shows the state of 180-degree crank angle, in which ignition is made near the piston top dead center. Although the piston lowers under pressure generated by ignited and burned gas, an upward force acts on the cylinder as described above so that the valve seat keeps press-contact with the valve disc. The opening 7 remains open until the cylinder is pressed down by the piston when the combustion gas is discharged attendant on opening of the outlet 13 as a result of further descent of the piston (FIG. 6 depicting the state of 280-degree crank angle).

FIG. 7 shows the state of 315-degree crank angle, in which the piston 5 abuts against the raised portion 14 at the bottom of the cylinder 3 to press down the cylinder. At that time, the valve seat 8 is disengaged from the valve disc 9 to open the opening 7, into which fresh air compressed in the crankcase flows, returning to the state of FIG. 2.

FIGS. 8 to 11 illustrate an example of application to a two-cycle engine.

As shown in FIG. 8, the engine generally designated at 1 comprises a cylinder 3 capable of rising and lowering, disposed above a crankcase 2. The cylinder 3 is urged upward by a cylinder spring 4. The lower end of the cylinder 3 comes into abutment against a raised portion 15 of the engine body upon the fall so that the cylinder 3 can lower to a limit required to open an outlet 13. A piston 5 is mounted within the cylinder 3 and is biased upward by a piston spring 16 which is supported on the lower end of the cylinder 3. In the diagram, reference numeral 6 denotes a crank.

An opening 7 is formed in the upper end face of the cylinder 3 so that a valve seat 8 is defined by the periphery 2o of the opening 7. Above the valve seat 8 is disposed a valve disc 9 which comes into abutment against the valve seat 8 when the cylinder 3 rises.

Between the upper end face of the cylinder 3 and the valve disc 9 is formed an inlet passage 10 which is opened when the cylinder 3 lowers. The inlet passage 10 leads via an inflow pipe 11 to the crankcase 2 such that fresh air sucked through an inlet 12 of the crankcase 2 is fed to the cylinder 3 by way of the inlet passage 10.

The piston spring 16 has a larger spring force than the cylinder spring 4 to ensure that the piston 5 closes the outlet 13 when the piston spring 16 has fully been stretched.

FIG. 8 illustrates the piston 5 located at its bottom dead center (crank angle of 0 degrees). In this state, the piston spring 16 is compressed, and the cylinder 3 is pressed and lowered by the piston 5, with the valve seat 8 and the valve disc 9 being separated from each other. Thus, fresh air flows through the inlet passage 10 into the cylinder 3 whilst resilient gas within the cylinder 3 is exhausted through the opened outlet 13, whereupon the interior of the cylinder 3 is filled with fresh air.

FIG. 9 illustrates the state of a 60-degree crank angle. In this state, the piston 5 rises but the cylinder 3 is pressed so as not to rise by a spring force of the piston spring 16. As a result, the opening 7 remains open and the outlet 13 is blocked by piston 5. Accordingly, inflow of fresh air continues after the blocking of the outlet 13 so that a so-called inertia super charging is performed.

FIG. 10 illustrates the state of an 85-degree crank angle. In this state, when the piston 5 further rises and the piston spring 16 is extended, the spring force of the cylinder spring 4 overcomes the spring force of the piston spring 16, allowing a rise of the cylinder 3 so that the valve seat 8 comes into abutment against the valve disc 9 to block the opening 7. The interior of the cylinder thus enters into the compression stroke.

In this compression stroke, the press-contact force between the valve seat 8 and the valve disc 9 increases as the compression increases. That is, the cylinder 3 is able to rise and, upon the rising of the piston, an upward force is applied to the upper end face of the cylinder. Thus, the valve seat 8 can come into press-contact wit the fixed valve disc 9.

This enables any leakage to be prevented with a simple valve structure in spite of a larger area of the opening 7.

FIG. 11 illustrates the state of a 180-degree crank angle where an ignition is carried out in the vicinity of the top dead center of the piston. The piston is lowered by pressure generated by the ignited and burned gas, whereas the cylinder is subjected to the upward force as described above so that the press-contact state is kept between the valve seat and the valve disc. The opening 7 remains closed until the piston is further lowered to open the outlet 13 for exhaust of the combustion gas, with the result that the cylinder is pressed down by the piston.

A further lowering of the piston 5 allows the lower end of the cylinder 3 pressed down by the piston spring 16 to come into abutment against the raised portion 15 of the body, so that the piston 5 lowers while compressing the piston spring 16, returning to the state of FIG. 8.

In the compression stroke, since the area of the opening 7 is smaller than the plane area of the piston 5, an axial force applied on the cylinder, corresponding to the difference in area, works in the direction pressing the valve, and the axial force is combined with the upward force obtained from a difference in spring force between the cylinder spring 4 and the piston spring 16. Hence, as the cylinder internal pressure goes up, the press-contact force between the valve seat and the valve disc increases so that the pressures of the compressed air and next combustion gas cannot leak out to the exterior.

In the above embodiment, only the piston 5 rises while pressing down the cylinder 3 under the action of the piston spring 16, whereupon inflow can continue with the outlet 13 closed as seen in FIG. 9, thus achieving the improved inflow efficiency.

DETAILED DESCRIPTION OF THE INVENTION

Best Mode 1 for Carrying out the Invention

Figure 1:
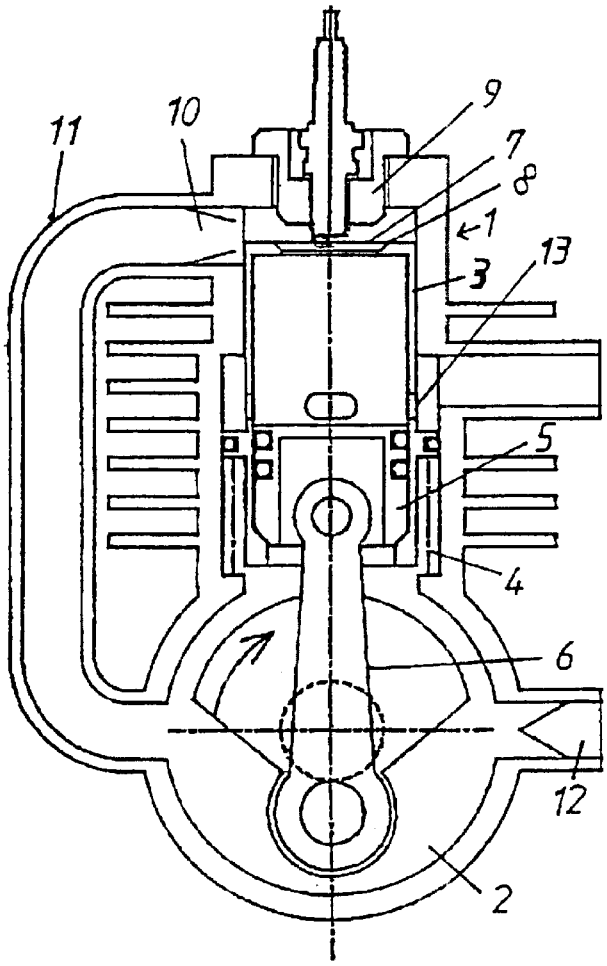
FIG. 1 is a sectional view explaining the principle of the present invention.
Figure 2:
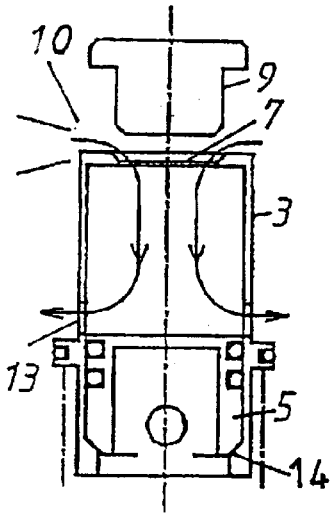
FIG. 2 is an explanatory diagram showing the state of a crank angle of 0 degrees of the same.
Figure 3:
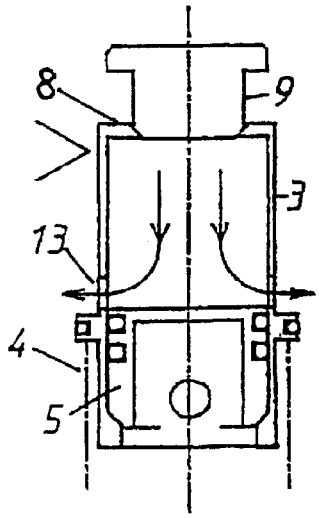
FIG. 3 is an explanatory diagram showing the state of a crank angle of 60 degrees of the same.
Figure 4:
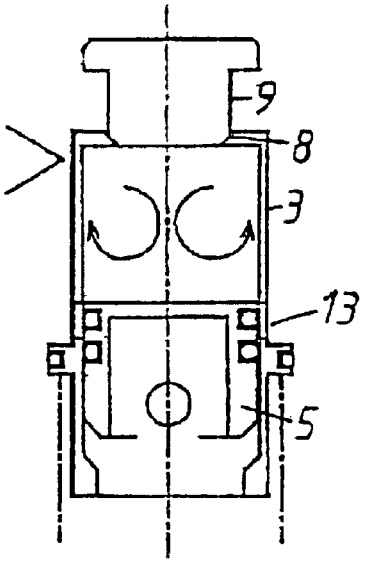
FIG. 4 is an explanatory diagram showing the state of a crank angle of 85 degrees of the same.
Figure 6:
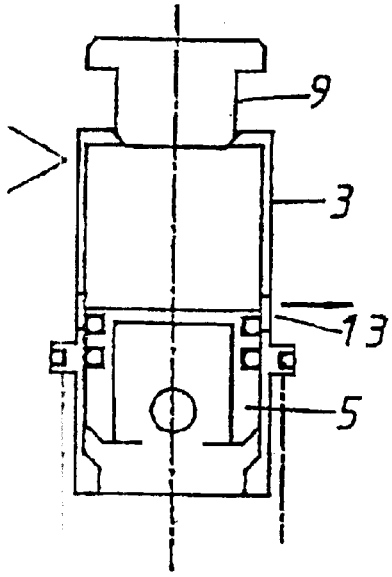
FIG. 6 is an explanatory diagram showing the state of a crank angle of 280 degrees of the same.
Figure 5:
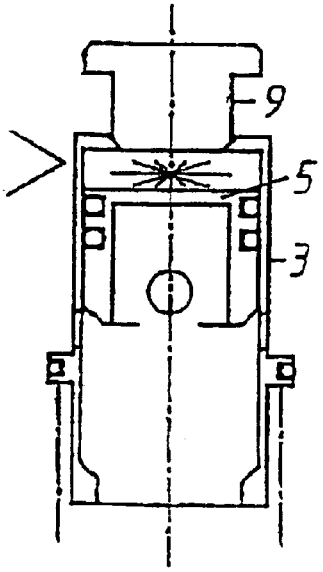
FIG. 5 is an explanatory diagram showing the state of a crank angle of 180 degrees of the same.
Figure 7:
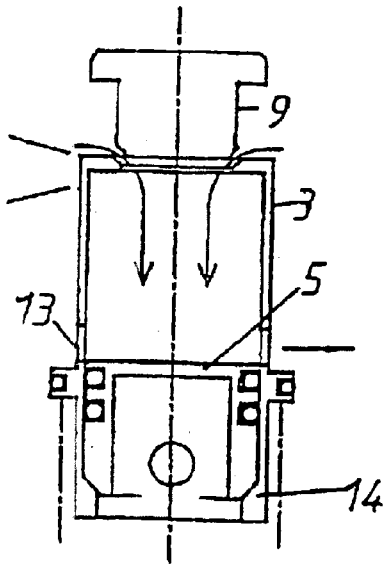
FIG. 7 is an explanatory diagram showing the state of a crank angle of 315 degrees of the same.
Figure 8:
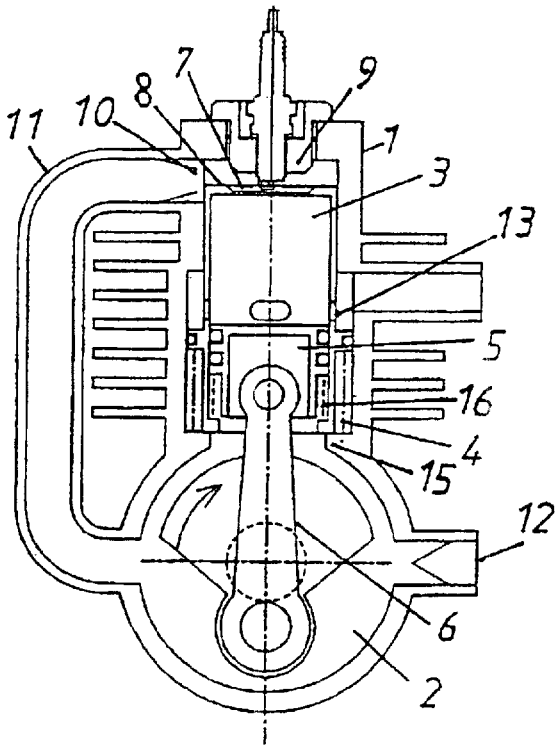
FIG. 8 is a sectional view showing a two-cycle engine of the present invention.
Figure 9:
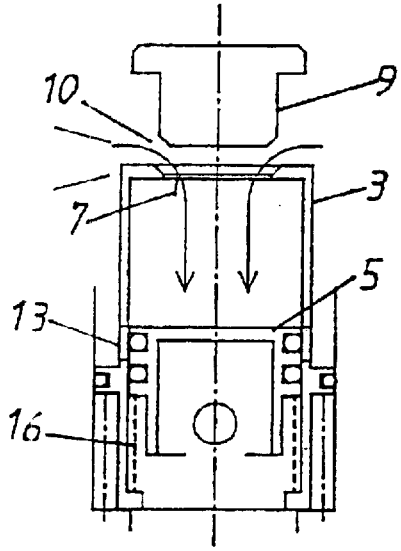
FIG. 9 is an explanatory diagram showing the state of a crank angle of 60 degrees of the same.
Figure 10:
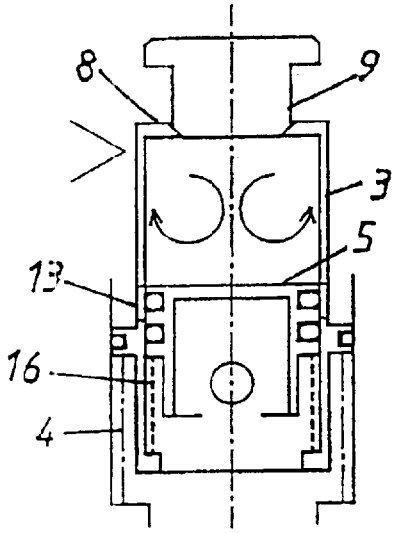
FIG. 10 is an explanatory diagram showing the state of a crank angle of 85 degrees of the same.
Figure 11:
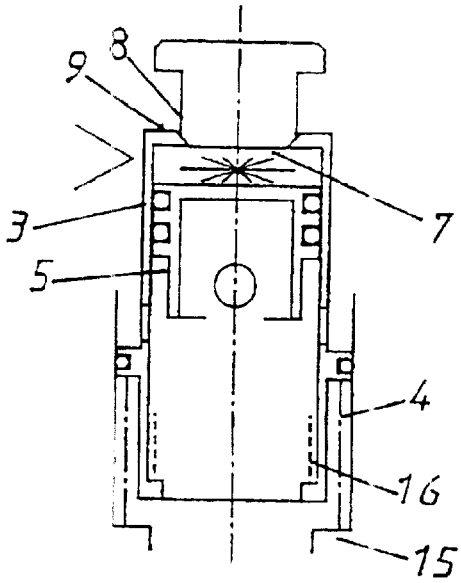
FIG. 11 is an explanatory diagram showing the state of a crank angle of 180 degrees of the same.
Figure 12:
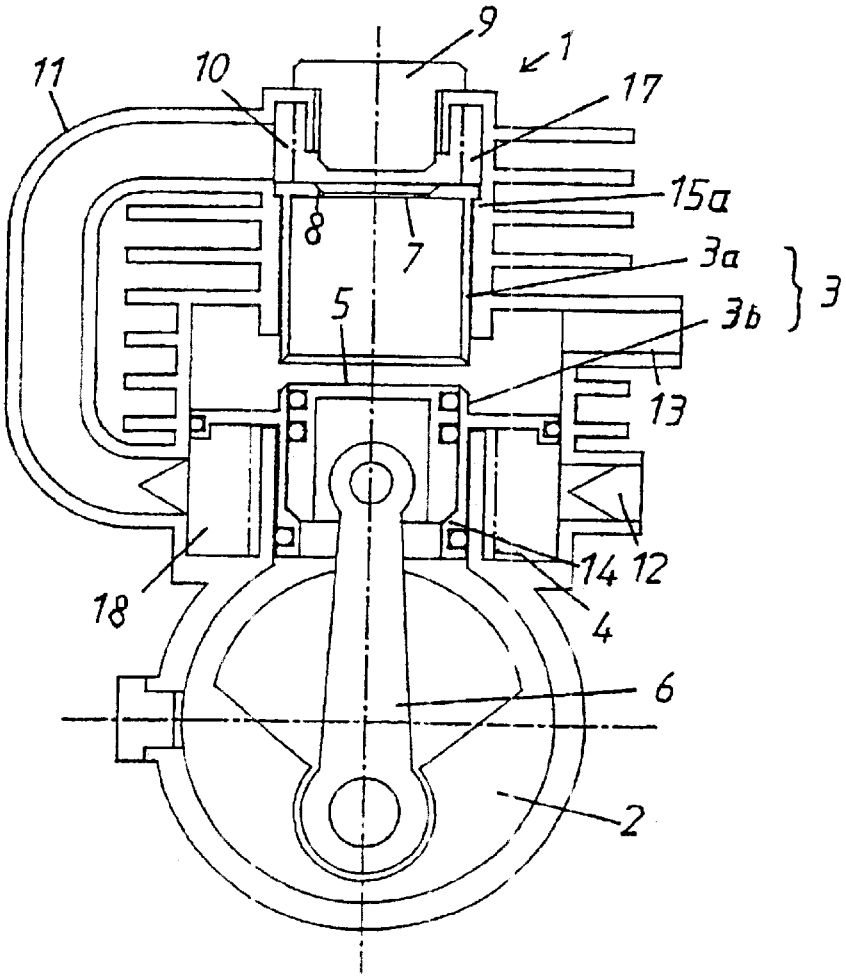
FIG. 12 is a sectional view showing a best mode 1 of the present invention.
Figure 13:
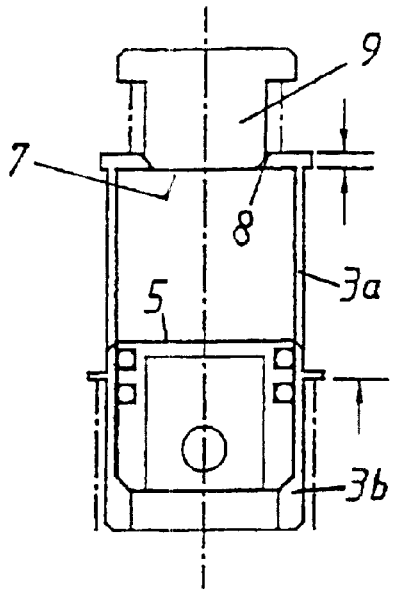
FIG. 13 is an explanatory diagram showing the state of a crank angle of 75 degrees of the same.
Figure 14:
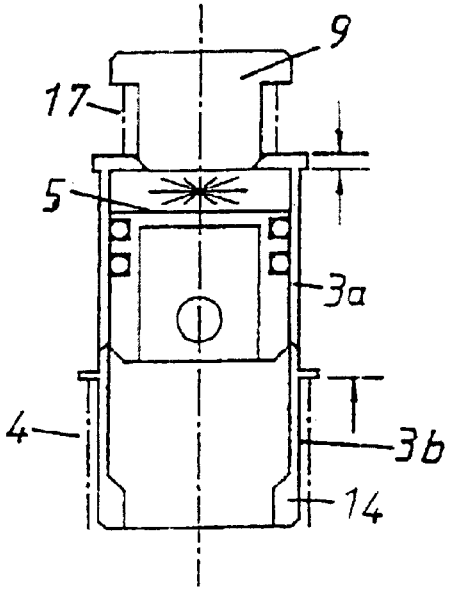
FIG. 14 is an explanatory diagram showing the state of a crank angle of 180 degrees of the same.

FIGS. 12 to 14 also illustrate an example of application to the two-cycle engine.

Referring to FIG. 12, the cylinder 3, which is capable of rising and lowering, is disposed above the crankcase 2 of the engine 1, with the piston 5 being mounted within the cylinder 3. The cylinder 3 consists of an upper cylinder 3*a* and a lower cylinder 3*b*. The upper cylinder 3*a* is urged downward by a valve spring 17, and the lower cylinder 3*b* is urged upward by the cylinder spring 4, which has a larger spring force than the valve spring 17.

The opening 7 is formed in the upper end face of the upper cylinder 3*a* such that the valve seat 8 is defined by the periphery of the opening 7. Above the valve seat 8 is disposed the valve disc 9 which comes into abutment against the valve seat 8 when the upper cylinder 3*a* rises.

Between the upper end face of the upper cylinder 3*a* and the valve disc 9 is formed the inlet passage 10 which is opened when the cylinder 3 lowers. The inlet passage 10 leads via the inflow pipe 11 to an inflow chamber 18, such that fresh air sucked through the inlet 12 of the inflow chamber 18 is fed to the cylinder 3 by way of the inlet passage 10.

Reference numeral 13 denotes the outlet.

FIG. 12 illustrates the piston 5 located at its bottom dead center (crank angle of 0 degrees) . In this state, the upper cylinder 3*a* is pressed down by the valve spring 17, with the valve seat 8 and the valve disc 9, being separated from each other to allow an inflow of fresh air through the inlet passage 10 into the cylinder 3. On the other hand, the lower end of the piston 5 is in abutment against a raised portion 14 formed on the lower end of the lower cylinder 3*b* such that the lower cylinder 3*b* is pressed downward by the piston 5. As a result, there arises a gap between the upper cylinder 3*a* and the lower cylinder 3*b* so that the interior of the cylinder 3 communicates with the outlet 13 for the exhaust of the resilient gas within the cylinder 3, whereupon the interior of the cylinder 3 is filled with fresh air.

When the piston 5 rises, the lower cylinder 3*b* rises by the spring force of the cylinder spring 4 and comes into abutment against the lower end of the upper cylinder 3*a*, closing the outlet 13. When the piston 5 further rises, the upper cylinder 3*a* is pressed up and raised by the lower cylinder 3*b* as seen in FIG. 13 (showing the state of 75-degree crank angle), with the result that the valve seat 8 comes into abutment against the valve disc 9 to close the opening 7, allowing the interior of the cylinder to enter into the compression stroke.

FIG. 14 illustrates the state of 180-degree crank angle where an ignition is performed in the vicinity of the top dead center. The piston lowers under pressure generated by the ignited and burned gas, whereas the cylinder 3 is subjected to an upward force as described above, so that the press-contact state is kept between the valve seat and the valve disc. When further lowering of the piston 5 causes the lower end of the piston 5 to come into abutment against the raised portion 14 of the lower cylinder 3*b*, the lower cylinder 3*b* is lowered. The instant that the outlet 13 opens as a result of the lowering of the lower cylinder 3, the combustion gas is "blown down", allowing an exhaust at a stroke.

On the contrary, the upper cylinder 3*a*, losing its upward force as a result of lowering of the lower cylinder 3*b*, is pressed down by the valve spring 17 when the internal pressure of the cylinder is reduced by the exhaust of the combustion gas, and the valve seat 8 is disengaged from the valve disc 9 to open the opening 7.

Figure 15:
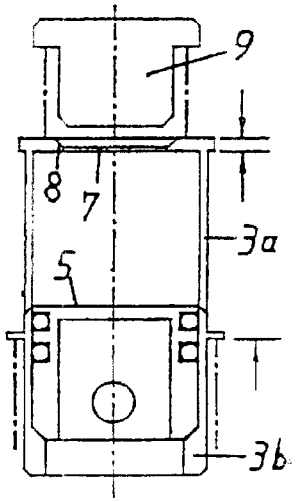
FIG. 15 is an explanatory diagram showing the state of a crank angle of 300 degrees upon the defective ignition of the same.

FIG. 15 illustrates the action that will take place in the absence of a fuel ignition. When no ignition is performed, the cylinder internal pressure is only the compression pressure. As a result, the valve seat 8 is pressed against the valve disc 9 in the vicinity of the top dead center of the piston 5, but lowering of the piston will cause reduction of the internal pressure. The upper cylinder 3*a* is thus lowered together with the lower cylinder 3*b*, and the outlet 13 is not opened until the piston goes down to the vicinity of the bottom dead center.

In the above compression step, similarly to the first embodiment, a higher cylinder internal pressure brings about a larger press-contact force between the valve seat and the valve disc, preventing the pressures of the compressed air and next combustion gas from leaking out to the exterior.

In the foregoing, the optimum size of the exhaust gap defined between the upper cylinder 3*a* and the lower cylinder 3*b* differs depending on the operation circumstances, but the position of a shoulder 15*a* of the body restricting the amount of descent of the upper cylinder may be variable so that an optimum exhaust status can be obtained.

Having the arrangement to fully be closed when the cylinder internal pressure is zero or negative will ensure an effect similar to that of the Cadenagy engine (two-cycle engine utilizing inflow due to cylinder reduced internal pressure immediately after the exhaust).

The above embodiment solves the problems of the conventional two-cycle engine as follows:

(1) Since the outlet is closed prior to closing of the inlet, pressure-charging is possible with less outflow of fresh air, whereby improved combustion efficiency is achieved and low-speed torque performance is especially improved with less emission of unburned HC.

(2) Separate provision of the inflow chamber 18 dispenses with the utilization of the crankcase 2 for inflow. Lubricant can therefore remain in the crankcase, similarly to the four-cycle engine, so that the lubricant cannot burn together with fuel, thus preventing any adhesion of carbon particles onto the ignition plug and changing of the emission gas into blue smoke.

(3) By virtue of the capability to position the outlet at the end of the engine tubular portion and to evenly disperse the emission heat around the cylinder, the cylinder itself can be free from local uneveness in temperature with less thermal deformation. For this reason, the fitting accuracy can be enhanced between the piston and the piston ring, whereby leakage of the combustion gas and the lubricant can be prevented as much as possible with higher airtightness.

(4) In case of no fuel ignition, the opening of the outlet can be delayed to suppress the exhaust, whereby blowing-through of the fuel upon the start can be suppressed with improved starting performance.

(5) Suction/exhaust conditions in operation can automatically be controlled. More specifically, when the combustion pressure is low in operation (low load) , the exhaust is made in a short time after ignition to reduce the cylinder internal pressure, so that the upper cylinder 3*a* can lower in a short time to block the outlet but open the inlet, thus suppressing the exhaust. On the contrary, when the combustion pressure is high, a longer time is required to reduce the internal pressure as a result of exhaust after ignition, so that the lowering of the upper cylinder is delayed. Thus, the opening time of the outlet is elongated and an efficient exhaust is achieved.

(6) A compressor could separately be disposed at the inflow side without providing the pump chamber so as to obtain a multi-cylinder engine with a reduced body diameter.

Figure 16:
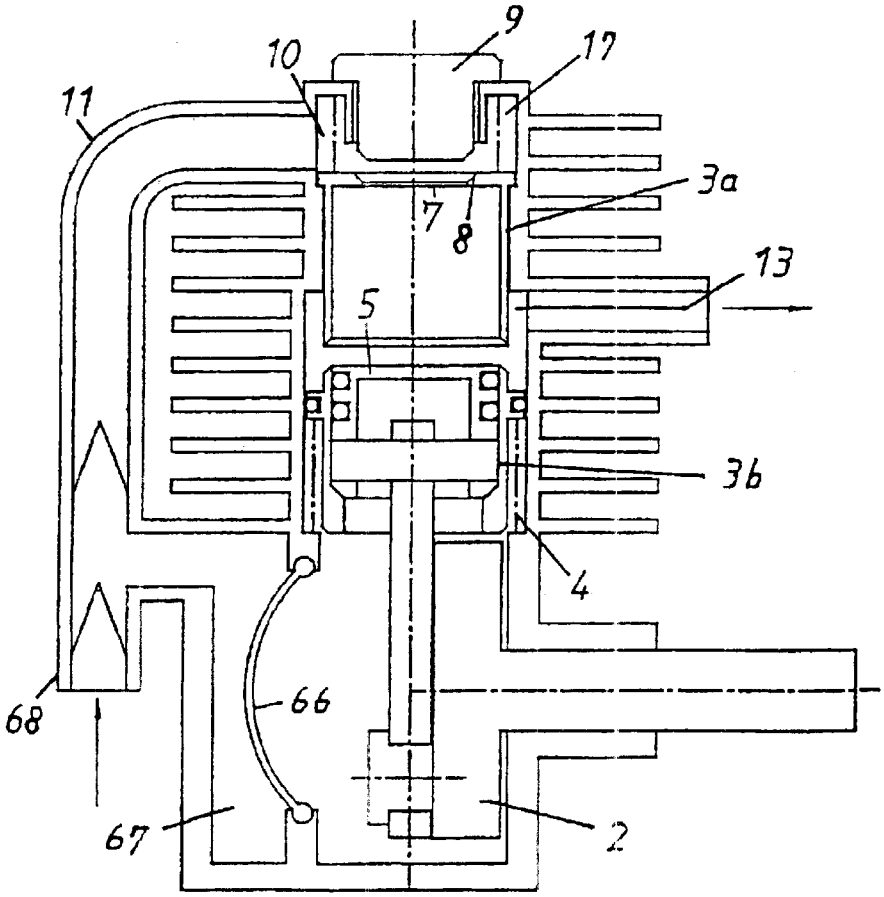
FIG. 16 is a sectional view showing another example of a best mode 1 of the present invention.

FIG. 16 shows another mode of the two-cycle engine adapted to perform scavenging without passage through the crankcase.

A diaphragm 66 is provided in the crankcase 2 so as to define a pump chamber 67 on one side thereof, with an inflow pipe 68 being connected to the pump chamber 67.

In this structure, using variations in pressure arising from the rise and lowering of the piston 5 and the cylinder 3, the diaphragm 66 is driven to acquire a pumping force to introduce external air through the inflow pipe 68, for scavenging. The other constructions and functions are substantially the same as the example of FIGS. 12 to 15.

Herein, due to the rise and lowering of the cylinder together with the piston, the cylinder outer peripheral portion in addition to the piston diameter add to the compression ratio within the space of the crankcase, thus achieving increased pumping force and improved scavenging efficiency.

Best Mode 2 for Carrying out the Invention

FIGS. 17 to 22 show an example of application to the four-cycle engine. Description of the same constructions as those already described will be omitted.

The cylinder 3 is urged upward by the cylinder spring 4 whilst the piston 5 is urged upward by the piston spring 16. The cylinder 3 has at its lower end a lock pin 19, which is removably arranged for locking the cylinder.

The lock pin 19 is controlled by an interlocking mechanism 20 so as to move away from or toward the cylinder 3 in response to rotations of the crank 6. Although the interlocking mechanism 20 is shown including a roller, a belt and a cam, the structure is not limitative, but instead, an electrical control may be provided.

Above the cylinder 3 are formed the inlet 12 and an outlet 22 which are provided with check valves 21*a* and 21*b*, respectively. The check valves are opened or closed by variations of the cylinder internal pressure.

Figure 17:
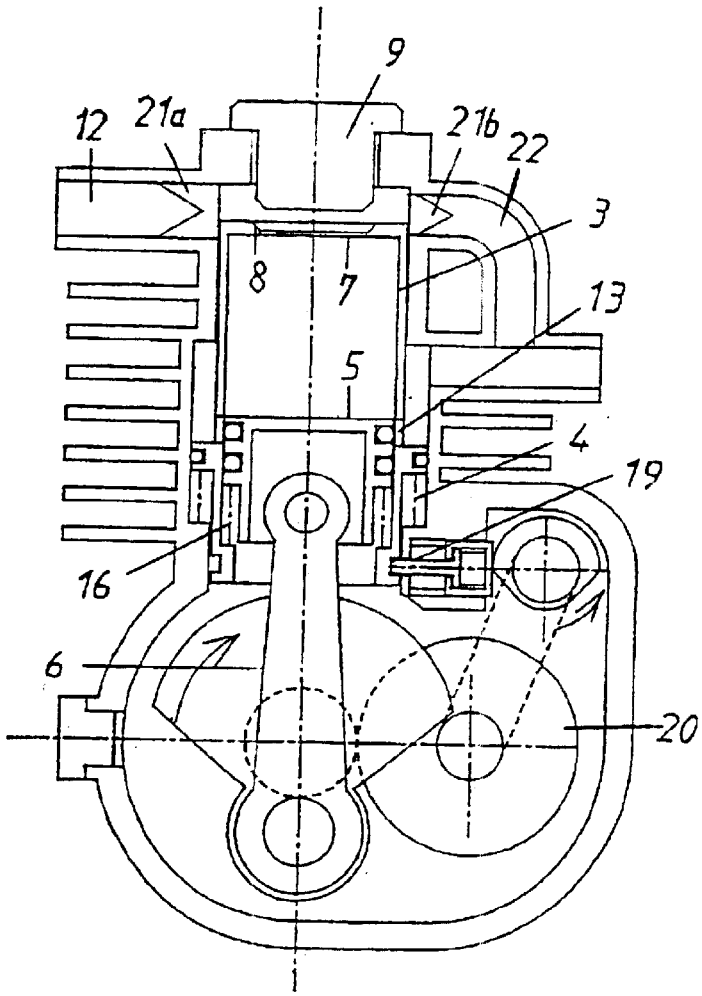
FIG. 17 is a sectional view showing a best mode 2 of the present invention.

In the foregoing, with the crank angle of 0 degrees shown in FIG. 17, the piston 5 is located at its bottom dead center, the lock pin 19 being engaged with the cylinder 3, the cylinder being located at its lower position to open the opening 7. The two check valves 21*a* and 21*b* are both blocked.

Figure 18:
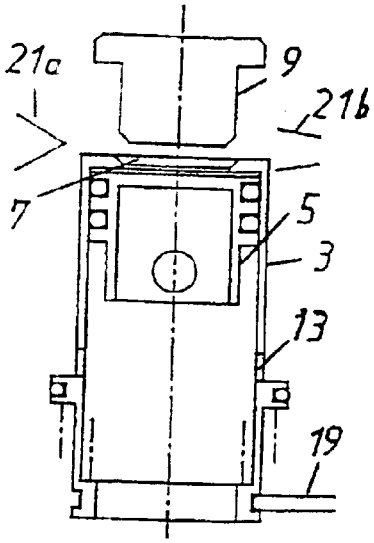
FIG. 18 is an explanatory diagram showing the state of a crank angle of 180 degrees of the same.

An upward movement of the piston 5 from this state causes the check valve 21*b* on the outlet side to open, allowing gas within the cylinder 3 to be exhausted therethrough (See FIG. 18 showing the state of 180-degree crank angle).

A subsequent downward movement of the piston 5 opens the check valve 21*a* on the inlet side but closes the check valve 21*b* on the outlet side, so that the fresh air is introduced into the cylinder 3.

Figure 19:
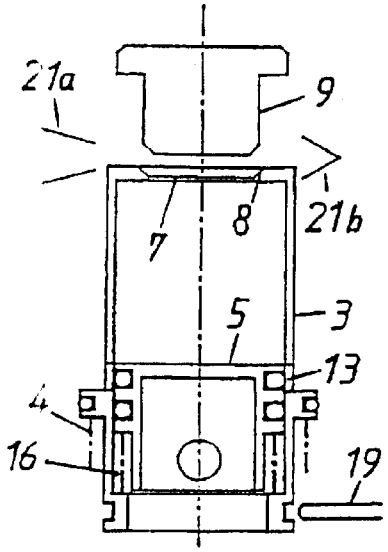
FIG. 19 is an explanatory diagram showing the state of a crank angle of 360 degrees of the same.

As seen in FIG. 19, when approaching the 360-degree crank angle, the cylinder 3 is pressed down against the cylinder spring 4 by the spring force of the piston spring 16, with the result that locking of the cylinder 3 by the lock pin 19 is released under the action of the interlocking mechanism.

Figure 20:
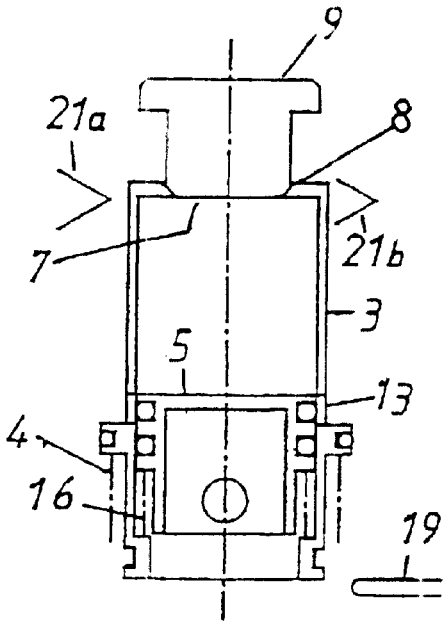
FIG. 20 is an explanatory diagram showing the state of a crank angle of 380 degrees of the same.
Figure 21:
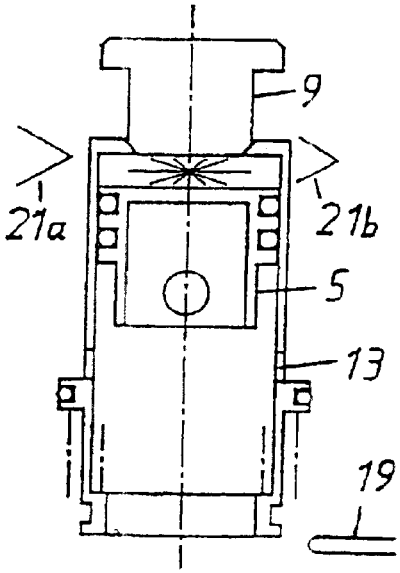
FIG. 21 is an explanatory diagram showing the state of a crank angle of 540 degrees of the same.
Figure 22:
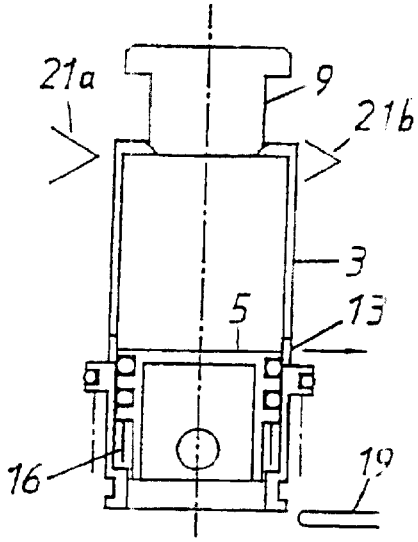
FIG. 22 is an explanatory diagram showing the state of a crank angle of 710 degrees of the same.
Figure 23:
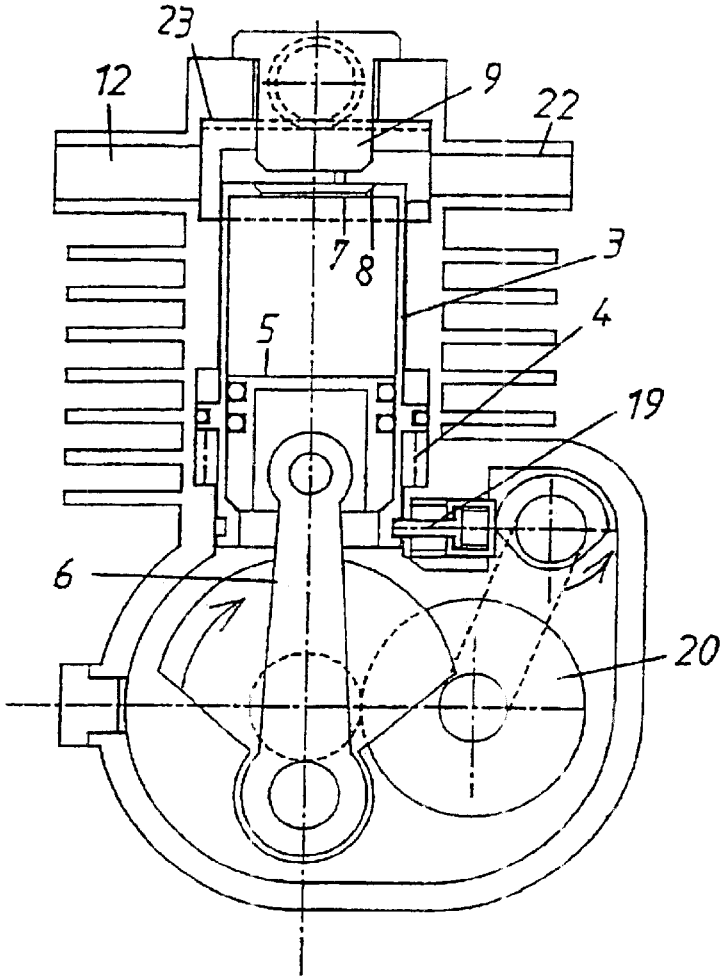
FIG. 23 is a sectional view showing a best mode 3 of the present invention.

As shown in FIG. 20 of the state of 380-degree crank angle, the piston moves upward with the cylinder 3 released from the lock pin 19, and when the urging force on the cylinder 3 by the piston spring 16 becomes small, the cylinder is raised by the spring force of the cylinder spring 4 so that the valve seat 8 comes into abutment against the valve disc 9 to block the opening 7. At that time, the two check valves 21*a* and 21*b* are closed, allowing entry into the compression stroke where fuel is ignited in the vicinity of the top dead center.

A rise in the cylinder internal pressure as a result of ignition of fuel causes a downward movement of the piston 5. When the piston passes through the outlet 13 of the cylinder 3, gas within the cylinder blows down from the outlet 13, resulting in a rapid drop of the cylinder internal pressure.

The drop of the cylinder internal pressure leads to a reduction in the upward force acting on the cylinder 5, with the result that the piston spring 16 is extended so that the cylinder 3 is pressed down by the piston spring 16. Then, at the 0-degree crank angle in the next cycle, the lock pin 19 is engaged with the cylinder 3 for locking the cylinder 3.

In this embodiment, the exhaust of the combustion gas is performed through the outlet 13 so that the exhaust of the combustion gas is separated from the exhaust for scavenging, which is performed through the outlet 22 positioned above the cylinder. For this reason, a high-temperature gas cannot pass through the valve regions at the top portion of the cylinder, so that the top portion is subjected to less high-temperature heating, contributing to improvement in the durability and reliability of the valve. Furthermore, the switchover between the outlet passage and the inlet passage can be effected by means of simple check valves that naturally automatically operate, eliminating the need for any mechanical drive unit.

Best Mode 3 for Carrying out the Invention

An embodiment shown in FIGS. 23 to 26 is configured such that the check valves 21*a* and 21*b* are substituted by a rotary valve 23 with no outlet formed in the peripheral wall of the cylinder 3, the exhaust being performed through only the outlet 22 located above the cylinder.

The absence of the outlet in the cylinder peripheral wall eliminates the need for the piston spring.

Figure 24:
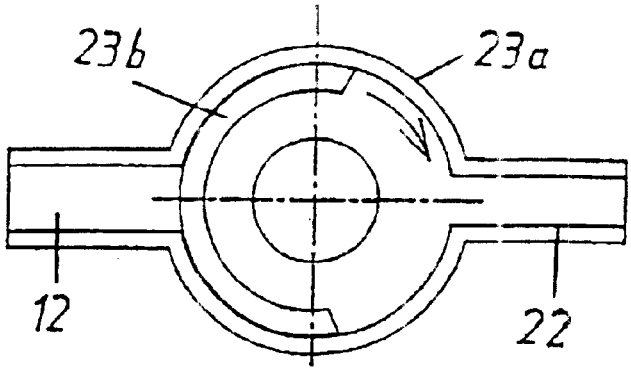
FIG. 24 is a sectional view of a rotary valve of the same.
Figure 25:
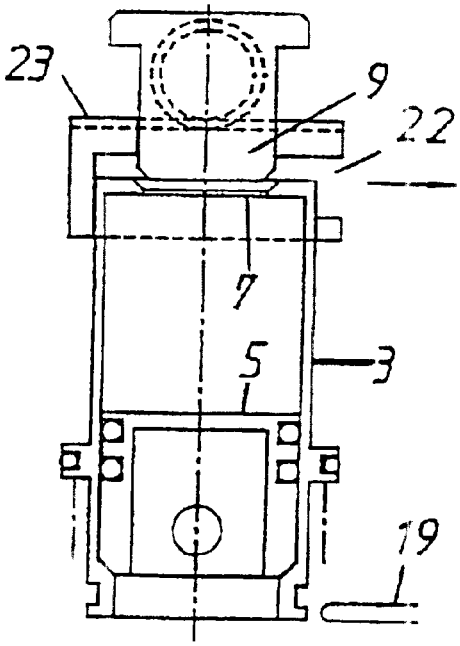
FIG. 25 is an explanatory diagram showing the state of a crank angle of 710 degrees of the same.

The rotary valve 23 is mounted between the inlet 12 and the outlet 22 which are located above the cylinder, the rotary valve 23 being structured to include a body 23*a* and a valve disc 23*b* as shown in FIG. 24. Control is then provided such that the inlet 12 and the outlet 22 are both closed when the piston lies in the vicinity of its bottom dead center in a first cycle, the outlet 22 being opened upon the rise of the piston, the inlet 12 being opened upon the fall of the piston, and that the inlet 12 and the outlet 22 are both closed at all times in a second cycle.

Control means of the rotary valve provides mechanical interlocking with the crank 6 (See FIG. 26) or an electrical control.

In this embodiment, gas is ignited when the piston lies in the vicinity of its top dead center in the second cycle, and an increase in the cylinder internal pressure causes an immediate fall of the piston 5, which in turn presses down the cylinder 3. The lowering of the cylinder opens the opening 7, with the result that the pressure gas is blown down for exhaust (See FIG. 25).

This embodiment uses the rotary valve for the switchover between the intake and exhaust so as to be less affected by heat even though the exhaust of the combustion gas is also performed through the top portion of the cylinder. The rotary valve 23 in this embodiment serves only to change over the direction of flow of the fluid so as to ensure smooth rotations with small loads.

Figure 26:
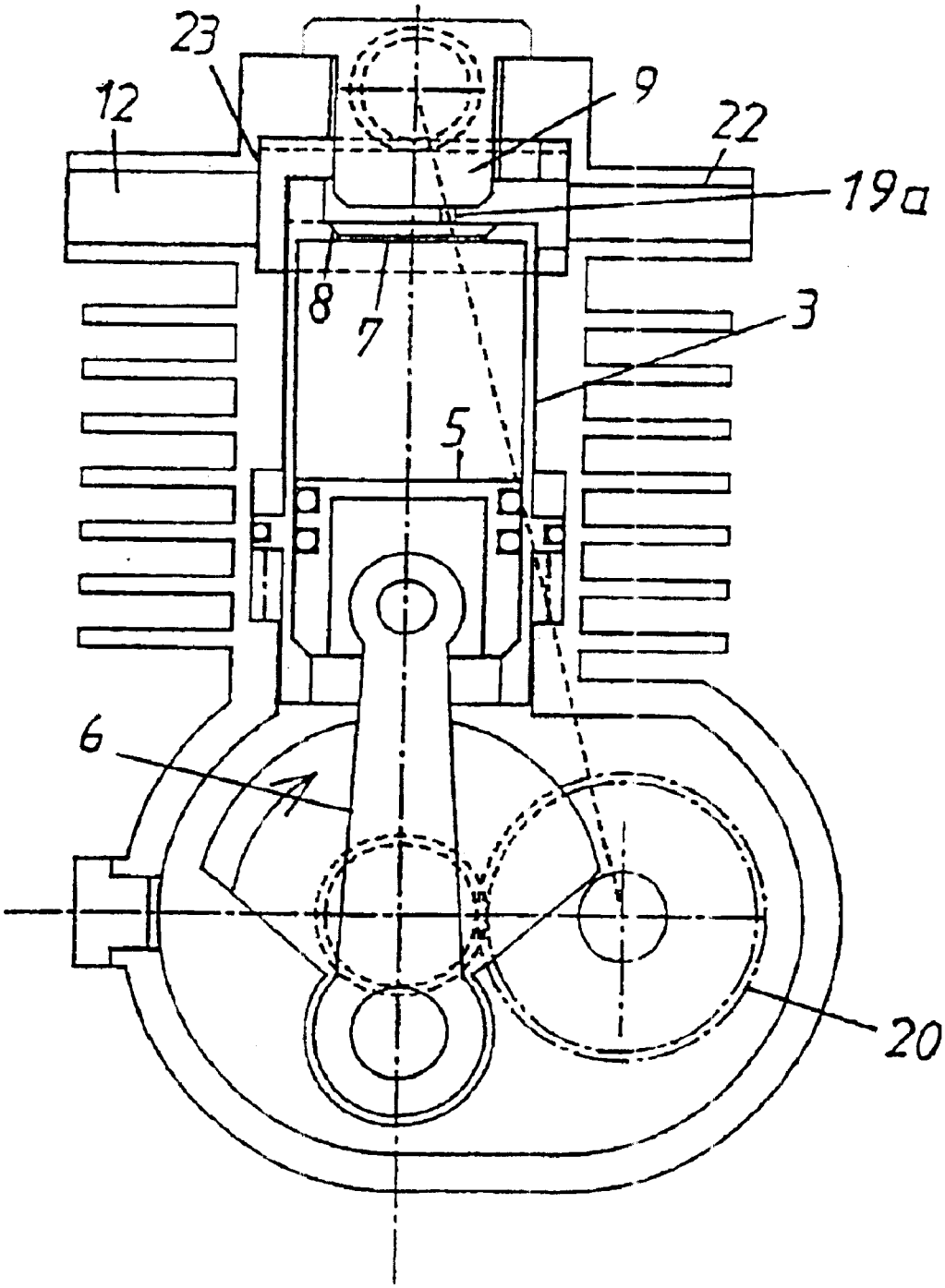
FIG. 26 is a sectional view showing an interlocking mechanism of a rotary valve of the same.

The example shown in FIG. 26 provides a control of the rise of the cylinder 3 by the rotations of the rotary valve 23 without providing the lock pin 19, which is engaged with the lateral wall of the cylinder 3.

More specifically, the cylinder 3 has a pin 19*a* that protrudes from its end face, whilst the body 23*a* of the rotary valve 23 has in its undersurface a groove (not shown) corresponding to the pin 19*a*. Because the rotational angle of the rotary valve 23 corresponds to the rise limit position of the cylinder 3, the cylinder is allowed to rise by increasing the depth of the groove through the rotational angles permitting the rise of the cylinder 3, whereas the rise position of the cylinder is controlled by reducing the depth of the groove (or by providing no groove) through the rotational angles where the cylinder should be positioned below.

To provide a similar control, the rotary valve 23 may be provided with the pin 19*a*, and the cylinder 3 may be formed with the groove.

Best mode 4 for Carrying Out the Invention

Figure 27:
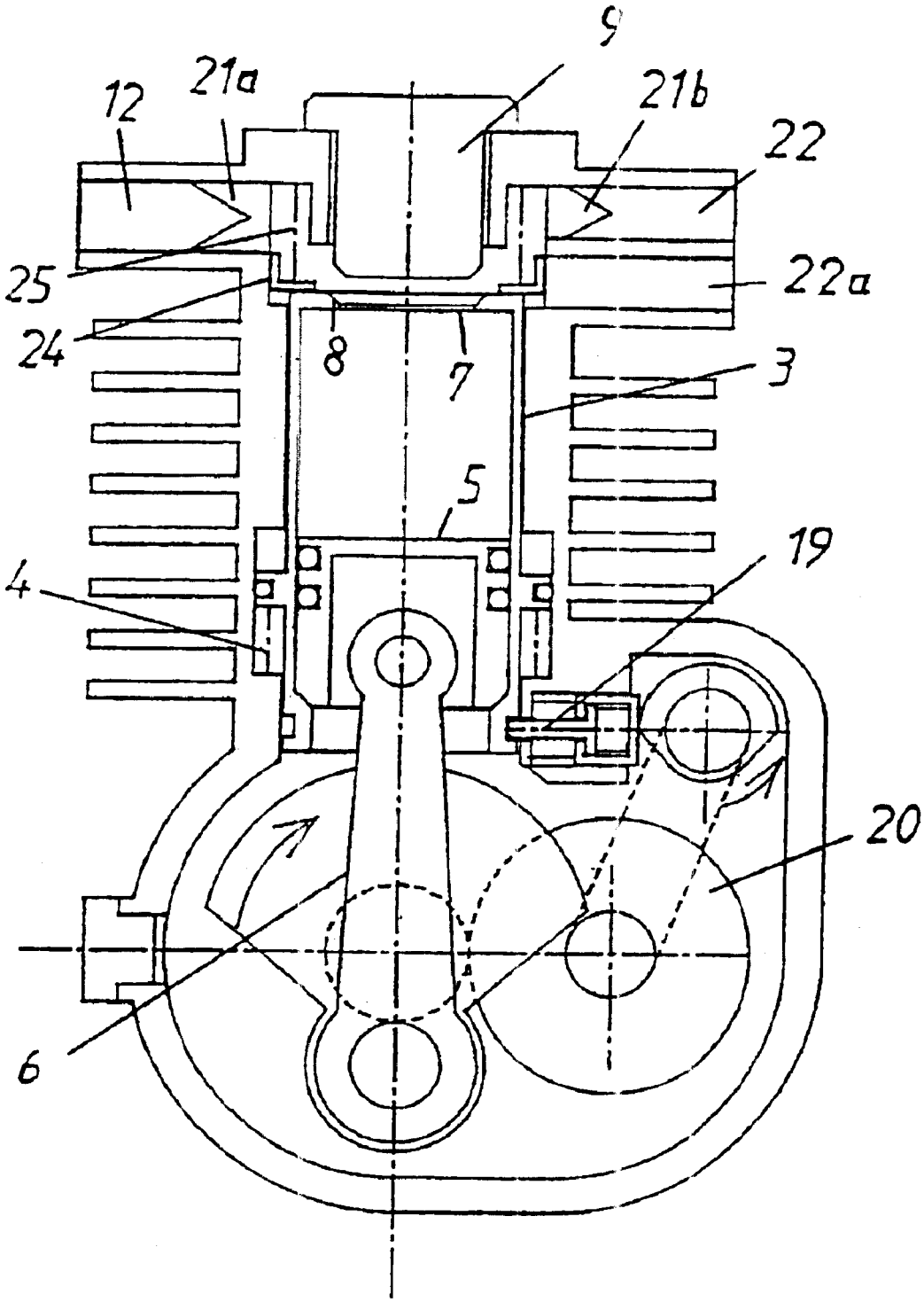
FIG. 27 is a sectional view showing a best mode 4 of the present invention.
Figure 28:
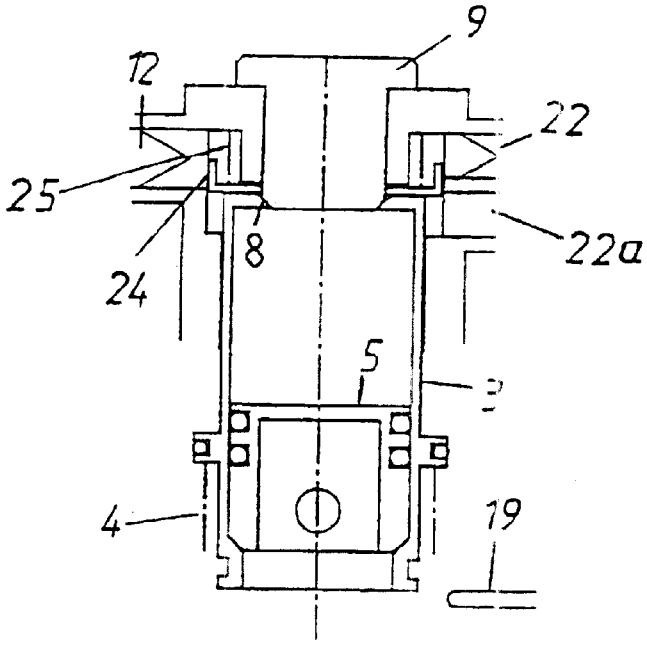
FIG. 28 is an explanatory diagram showing the state of a crank angle of 380 degrees of the same.
Figure 29:
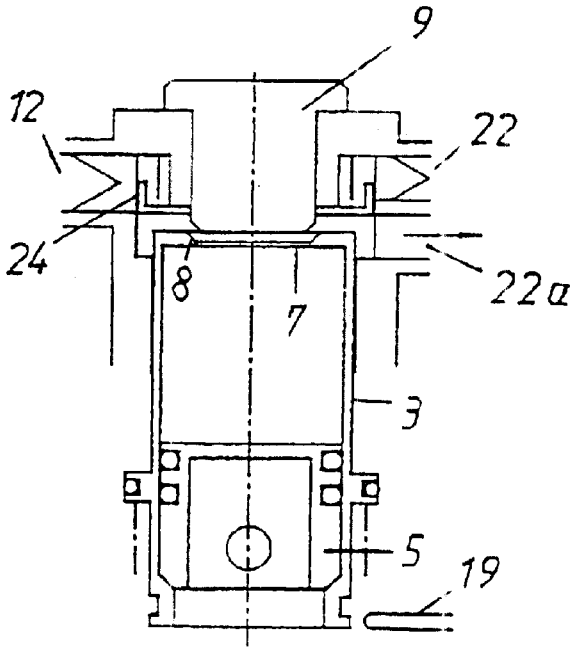
FIG. 29 is an explanatory diagram showing the state of a crank angle of 710 degrees of the same.

An embodiment shown in FIGS. 27 to 29 is another example where the blow-down of the combustion gas is also performed through the opening 7.

Referring to FIG. 27 (0-degree crank angle), above the cylinder 3 are arranged the inlet 12 with the check valve 21*a*, the outlet 22 with the check valve 21*b*, and a combustion gas outlet 22*a* formed below the outlet 22. The combustion gas outlet 22*a* is fitted with an annular selector valve 24 having an L-shaped section that is free to rise and lower, the selector valve 24 being urged downward by a valve spring 25 so that the undersurface of the selector valve 24 is in abutment against the upper end face of the cylinder 3. It is to be noted that the abutment force (strength of the valve spring) is so set that the selector valve 24 is pressed up by the casing internal pressure in the state of FIG. 29 which will be described later, to open the combustion gas outlet 22*a*.

In this embodiment, during the first cycle, the cylinder 3 is locked by the lock pin 19 so as not to rise, whereupon the selector valve 24 is pressed down by the spring force of the valve spring 25 to block the combustion gas outlet 22*a* at all times.

In the second cycle, the locking of the lock pin 19 is released to allow a rise of the cylinder 3 (See FIG. 28 showing the state of 380-degree crank angle), with the result that the opening 7 is blocked and the interior of the cylinder is compressed so that the gas is ignited in the vicinity of the top dead center of the piston and an increase in the internal pressure arising from the ignition causes the immediate fall of the piston to press down the cylinder 3, to thereby open the opening 7. At that time, the combustion gas pressure acts via the opening 7 on the undersurface of the selector valve 24 to thrust up the selector valve 24, so that the combustion gas outlet 22*a* is opened for exhaust of the combustion gas through the outlet 22*a* (See FIG. 29 depicting the state of 710-degree crank angle).

Figure 30:
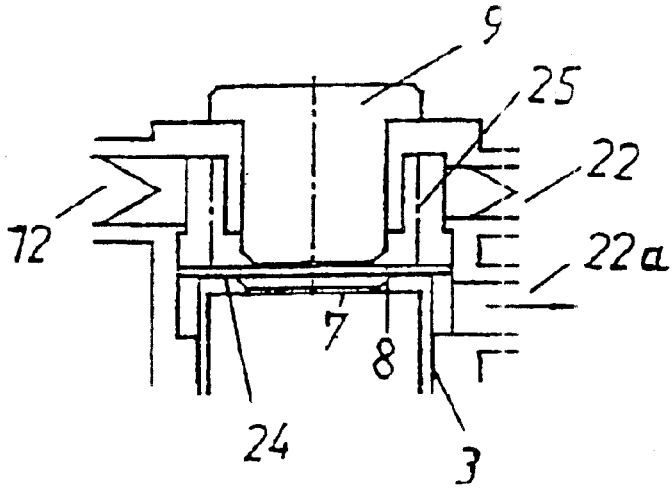
FIG. 30 is an explanatory diagram, at a crank angle of 0 degrees, showing another structure of a selector valve.
Figure 31:
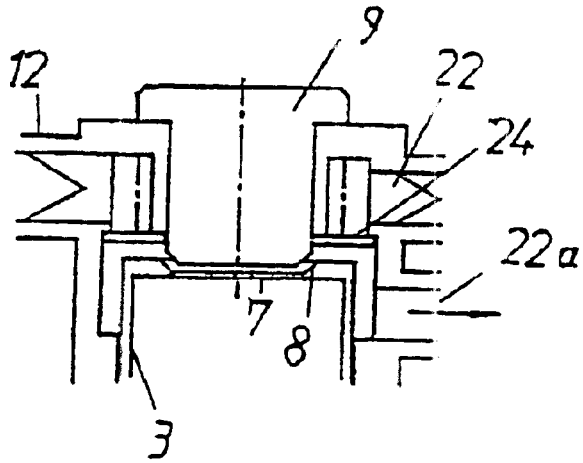
FIG. 31 is an explanatory diagram showing the state of a crank angle of 710 degrees of the same.

FIGS. 30 and 31 show another structure of the selector valve.

Herein, the selector valve 24 is in the form of an annular disc that is urged downward by the valve spring 25. The combustion gas outlet 22*a* is located below the position of the cylinder upper end face upon the fall of the cylinder 3 such that in the state of 0-degree crank angle shown in FIG. 30, the gap between the cylinder opening 7 and the outlet 22*a* is blocked by the selector valve 24, which is brought into abutment against the upper end face of the cylinder by the spring force of the valve spring 25.

This structure is similar to the structure of FIG. 27 in that the selector valve 24 is pushed up upon the rise of the cylinder internal pressure to allow the cylinder opening 7 and the outlet 22*a* to be in communication with each other (See FIG. 31 depicting the state of 710-degree crank angle).

According to this embodiment, all the actions required for the suction/exhaust changeover of the piston valve, the check valves, etc., are automatically effected by the gas pressure to eliminate the need for the suction/exhaust timing control.

Figure 32:
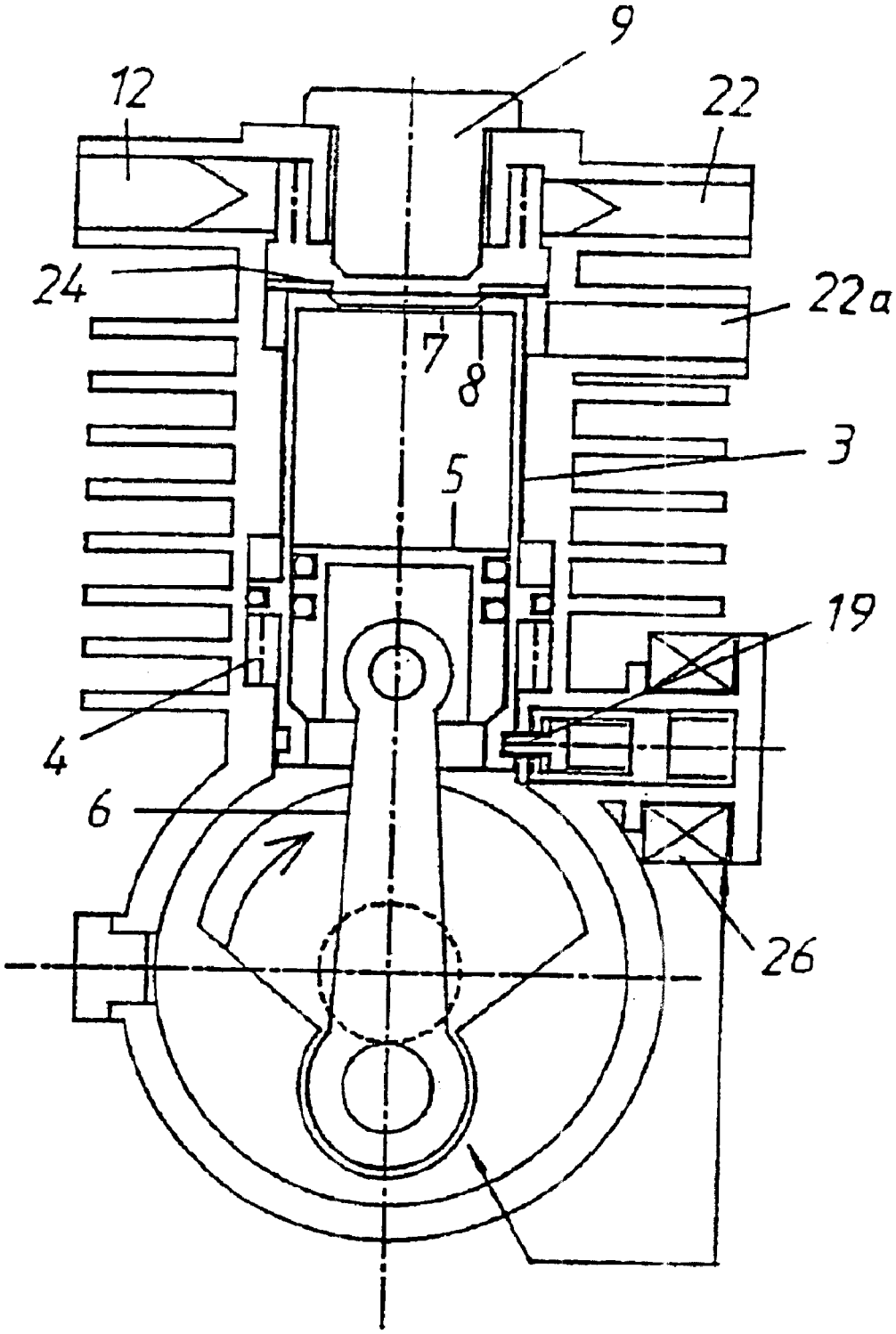
FIG. 32 is a sectional view showing an example of a lock pin controller.

FIG. 32 shows an example of a controller for the lock pin 19 for locking the cylinder in the above embodiments of the four-cycle engine.

More specifically, the lock pin 19 is moved away from or toward the cylinder 3 by means of a solenoid 26. In this case, the position of the crank 6 is detected by a sensor, which issues an electric signal to turn on/off the solenoid.

FIGS. 33 to 44 show a double-valve structure, with FIGS. 33 to 39 depicting an example of application to the two-cycle engine, with FIGS. 40 to 43 depicting an example of application to the four-cycle engine.

In either case, the cylinder valve seat 8 and valve disc 9 are not in direct abutment against each other, with an annular intermediate valve 27 disposed therebetween so as to define flow passages between the top surface of the intermediate valve 27 and the valve disc 9 and between the undersurface of the intermediate valve and the valve seat 8.

Best Mode 5 for Carrying out the Invention

Figure 33:
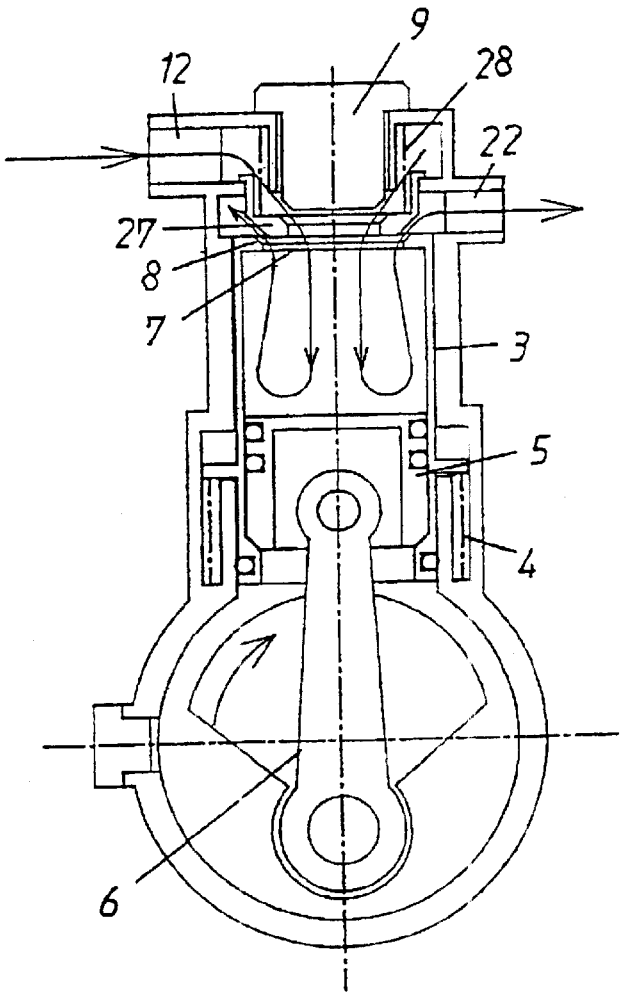
FIG. 33 is a sectional view showing a best mode 5 of the present invention.

Referring to FIG. 33 which depicts the application to the two-cycle engine, the intermediate valve 27 is interposed between the cylinder 3 and the valve disc 9, with the undersurface of the intermediate valve 27 being in abutment against the valve seat 8 of the opening 7, and with the top surface of the intermediate valve 27 being in abutment against the valve disc 9, such that when the valve disc comes into abutment against the intermediate valve 27, the opening 7 of the cylinder 3 is blocked. Then, the intermediate valve 27 is urged downward by a valve spring 28.

The cylinder 3 upon the rise blocks the outlet 22.

Herein, when the piston 5 lies at its bottom dead center (FIG. 33), the intermediate valve 27 is pressed down by the valve spring 28 to form an inflow passage between the top surface of the intermediate valve 27 and the valve 9. An outflow passage is formed between the undersurface of the intermediate valve 27 and the valve seat 8.

Therefore, a mixture gas under pressure delivered from a scavenging pump (not shown) flows through the inlet 12 into The cylinder 3 and strikes on the piston 5 to be reversed for exhaust from the outlet 22 so that the interior of the cylinder is scavenged.

This flow of the mixture gas is evaluated to have a higher scavenging effect than the Schneale method which may most frequently be utilized, and has a high efficiency which comes next to the uni-flow method.

Figure 34:
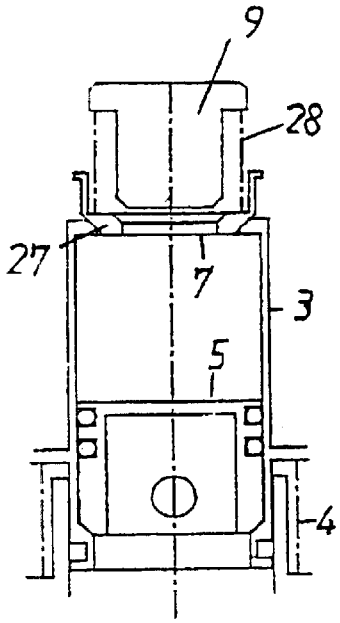
FIG. 34 is an explanatory diagram showing the state of a crank angle of 37 degrees of the same.

When the piston 5 rises, the cylinder 3 is raised by the spring force of the cylinder spring 4 to allow the intermediate valve 27 to come into abutment against the valve seat 8 to block the space between the opening 7 of the cylinder 3 and the outlet 22 so that only the inflow is continued (See FIG. 34 depicting the state of 37-degree crank angle).

Figure 35:
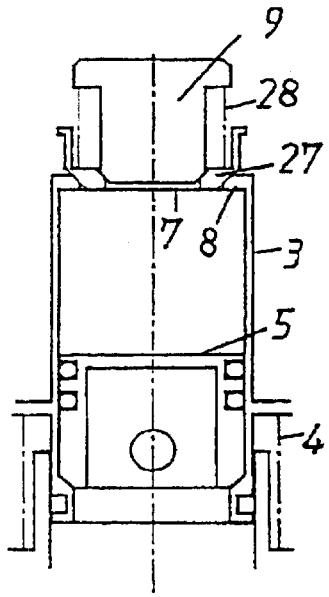
FIG. 35 is an explanatory diagram showing the state of a crank angle of 59 degrees of the same.

A further rise of the piston 5 results in a further rise of the cylinder 3, which in turn raises the intermediate valve 27 to bring the intermediate valve 27 into abutment against the valve disc 9 to block the opening 7, allowing an entry into the compression step (See FIG. 35 depicting 59-degree crank angle).

Figure 36:
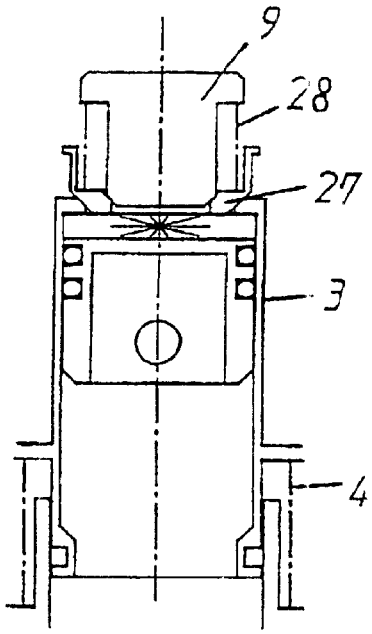
FIG. 36 is an explanatory diagram showing the state of a crank angle of 180 degrees of the same.

Then, the gas is ignited in the vicinity of the top dead center of the piston 5 (See FIG. 36).

Figure 37:
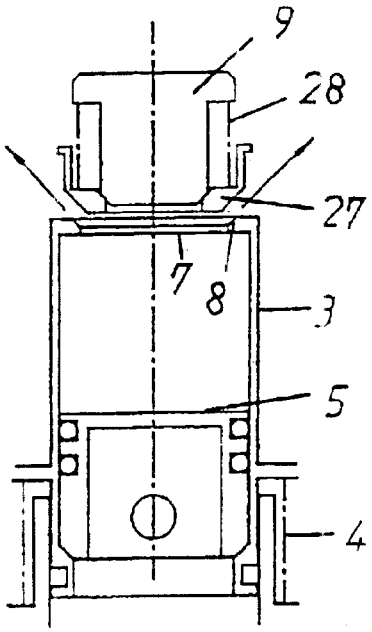
FIG. 37 is an explanatory diagram showing the state of a crank angle of 323 degrees of the same.

When the piston 5 is pressed down and the cylinder 3 lowers as a result of increase in the cylinder internal pressure attendant on the combustion of gas, the intermediate valve 27 is pushed up against the valve spring 28 by the cylinder internal pressure, so that the exhaust passage side is opened for immediate exhaust of the combustion gas (See FIG. 37 depicting the state of 323-degree crank angle).

Figure 38:
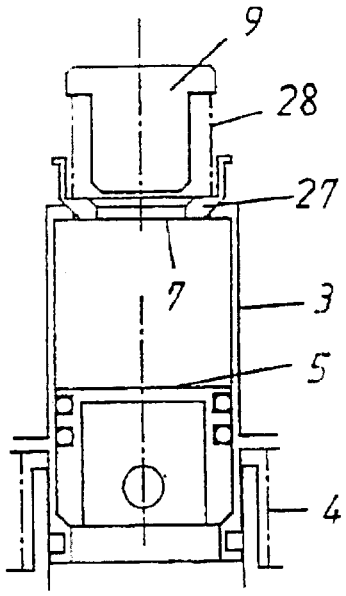
FIG. 38 is an explanatory diagram showing the state of a crank angle of 323 degrees upon the defective ignition of the same.

In the event that the fuel is not ignited in the foregoing, the cylinder internal pressure cannot increase and hence the intermediate valve 27 lowers together with the cylinder 3 (See FIG. 38 depicting the state of 323-degree crank angle) so that the inlet is first opened and a further lowering of the cylinder causes the outlet 22 to open.

Figure 39:
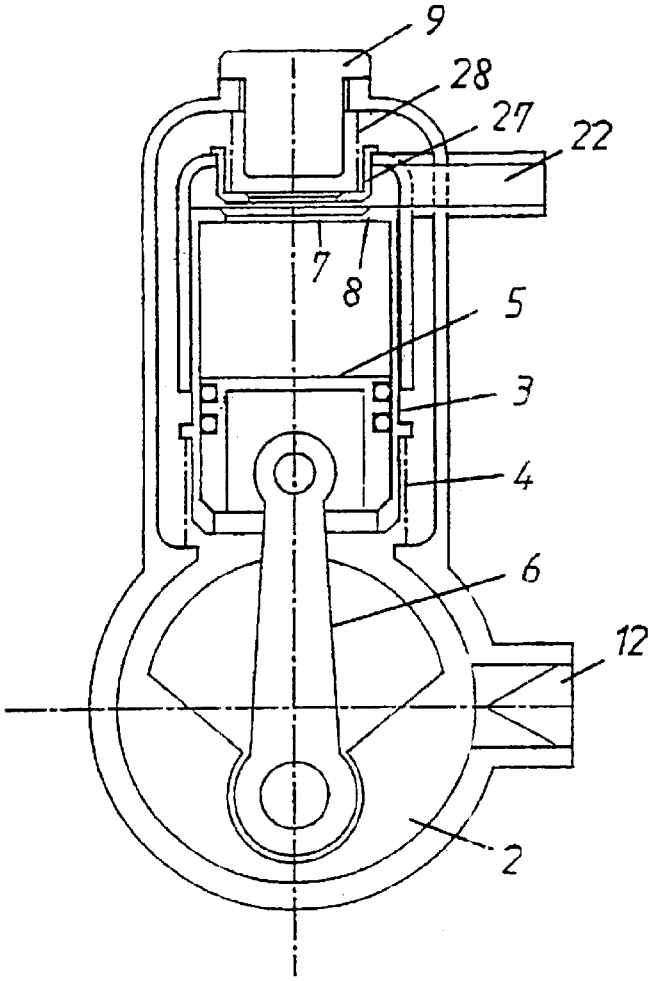
FIG. 39 is a sectional view showing an exemplary application to a 2-cycle engine.
Figure 40:
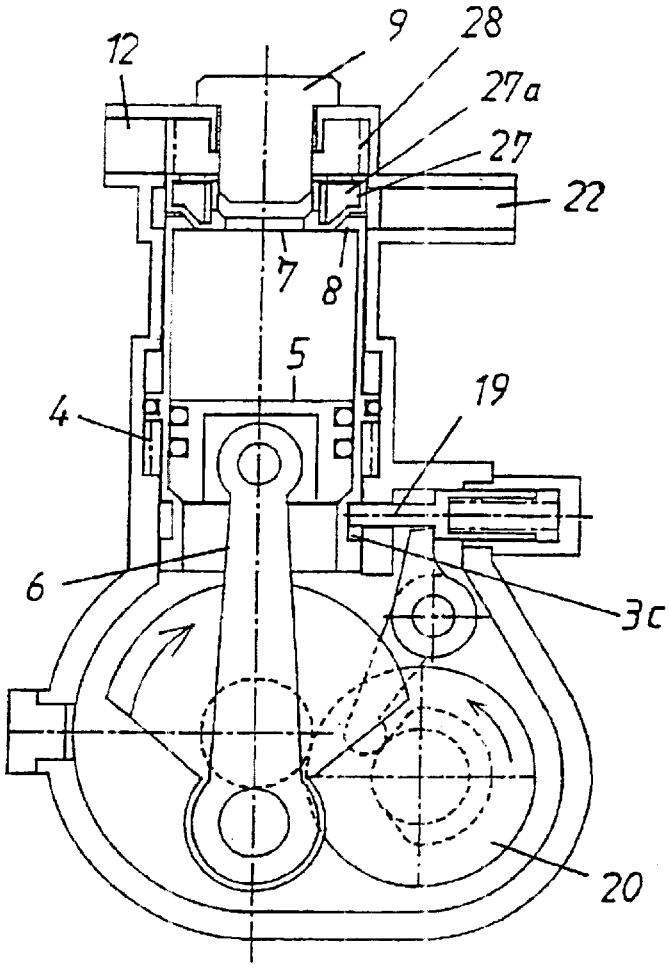
FIG. 40 is a sectional view showing a best mode 6 of the present invention.

FIG. 39 shows an application of the above valve structure to the two-cycle engine of the crankcase compression type.

This embodiment is similar to the above embodiment except that the crankcase is provided with an inlet.

These embodiments can provide a two-cycle engine capable of completing its suction/exhaust without vertically dividing the cylinder as in the embodiment 2, and without forming the outlet in the cylinder peripheral wall.

Cool fresh air having a larger specific gravity impinges on the top surface of the piston from just above the cylinder to provide a cooling effect, and is reversed to purge the residual combustion gas through the outlet in such a manner as to lay concentric circles one on top of another. A novel scavenging method analogous to the reverse ventilation method can thus be obtained.

Best Mode 6 for Carrying out the Invention

FIGS. 40 to 43 show an application to the four-cycle engine. Herein, the intermediate valve 27 is formed with a flow passage 27*a* with a check valve adapted to permit only the inflow, the flow passage 27*a* extending from the top surface toward the inner side surface. In the first cycle, the lock pin 19 is engaged with the cylinder 3 to prevent cylinder 3 from rising, but a receiving groove 3*c* of the cylinder 3 has a margin to allow a slight rise of the cylinder in the first cycle as well.

Herein, when the piston 5 rises from its bottom dead center (FIG. 40), the intermediate valve 27 is raised against the valve spring 28 under the exhaust pressure of the remaining gas so that the outlet 22 is opened for exhaust of the residual gas.

Figure 41:
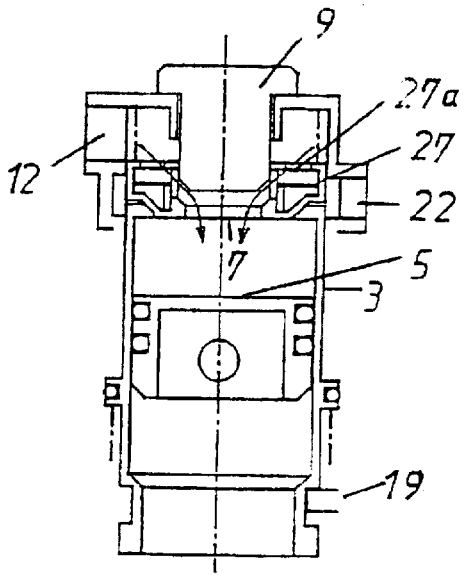
FIG. 41 is an explanatory diagram showing the state of a crank angle of 260 degrees of the same.
Figure 42:
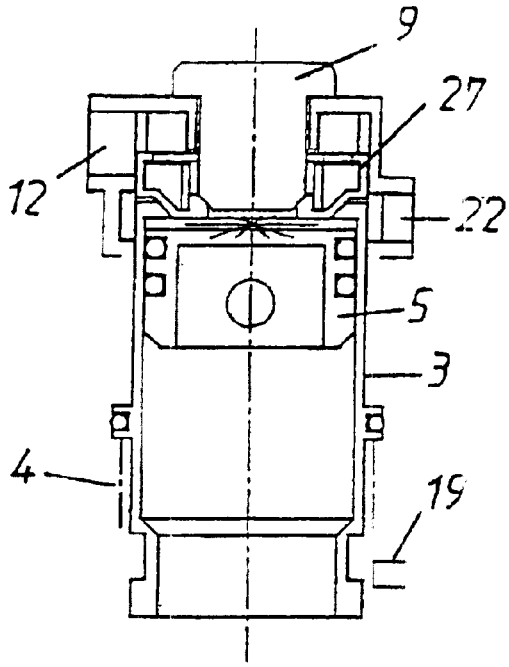
FIG. 42 is an explanatory diagram showing the state of a crank angle of 540 degrees of the same.

When the piston 5 lowers after reaching its top dead center, the intermediate valve 27 is lowered by the valve spring 28 into abutment against the upper end face of the cylinder 3 to block the outlet 22, whilst fluid communication is placed between the inlet 12, the flow passage 27a and the opening 7 so as to allow fresh air to flow into the cylinder 3 (See FIG. 41 depicting the state of 260-degree crank angle).

Figure 43:
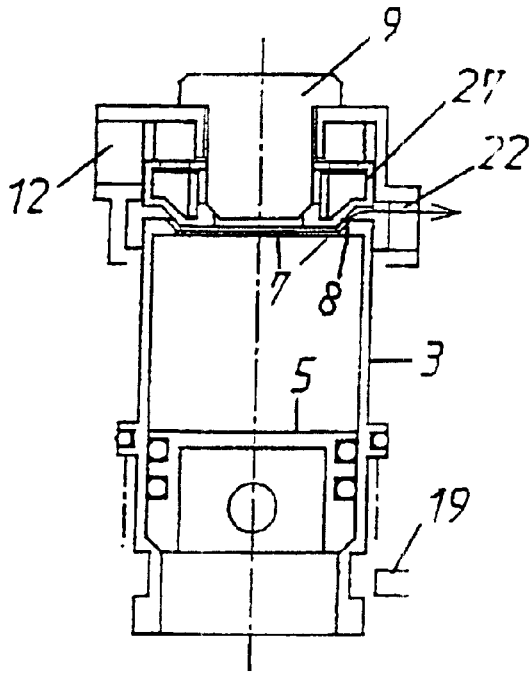
FIG. 43 is an explanatory diagram showing the state of a crank angle of 710 degrees of the same.

In the second cycle, a rise of the cylinder 3 brings about pushing-up of the intermediate valve 27, which in turn blocks the opening of the cylinder 7 so that the cylinder internal pressure is compressed and that the gas is ignited near the top dead center of the piston 5. An increase in the pressure arising from the ignition of gas causes a pressing-down of the piston 5, which in turn presses down the cylinder 3 near its bottom dead center, as a result of which there appears a gap between the intermediate valve 27 and the upper end face of the cylinder 3, the combustion gas being exhausted from the outlet 22 by way of this gap (See FIG. 43 depicting the state of 710-degree crank angle).

Figure 44:
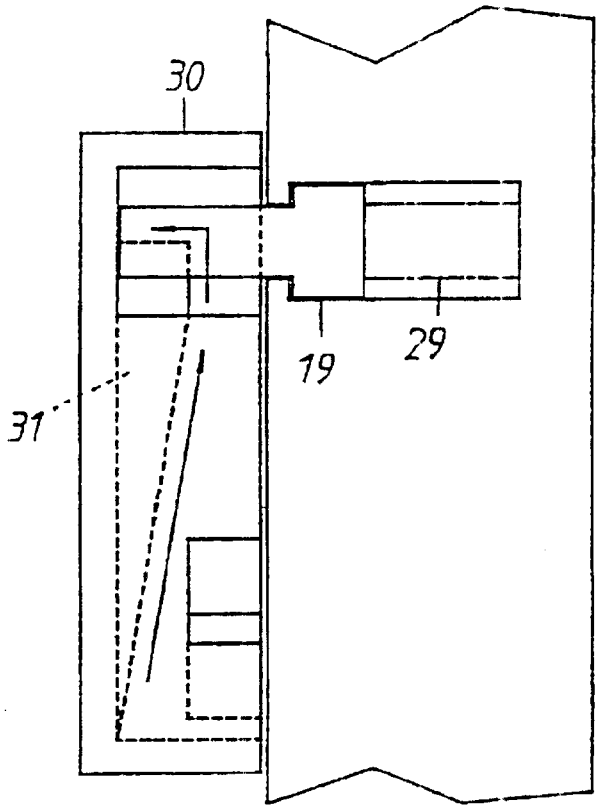
FIG. 44 is a sectional view showing a lock pin control by way of example.
Figure 45:
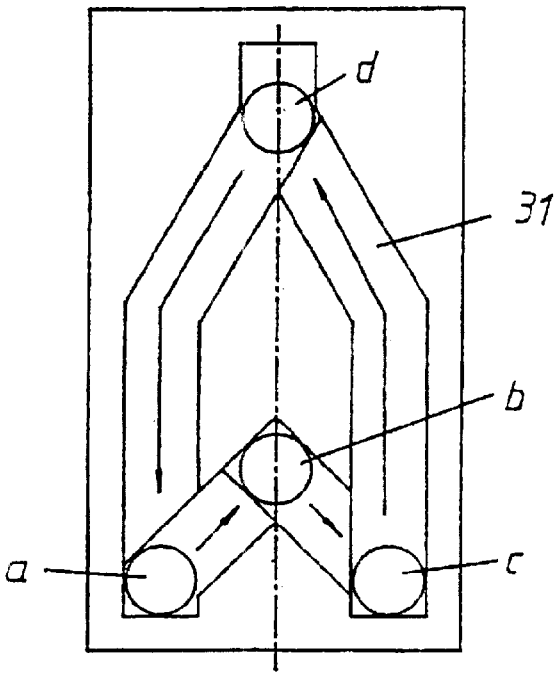
FIG. 45 is an explanatory diagram of a cam groove of the same.

FIGS. 44 and 45 show an example employing a cam mechanism for the control of the lock pin and which is applicable to the above embodiments using the lock pin.

Referring to FIG. 44, the lock pin 19 is attached to the lower portion of the cylinder 3 and is urged in its projecting direction by the spring 29, with the extremity of the lock pin 19 being fitted into a cam groove 31 formed in a block 30 which is secured to the side wall of the piston 5.

The positional relationship between the cam groove 31 and the lock pin 19 is such that the lock pin is positioned at a of FIG. 45 when the crank angle is 0 degrees where the piston 5 lies at its bottom dead center, that it is positioned at b to permit a slight rise of the cylinder 5 when the crank angle is 180 degrees, that it is positioned at to allow a descent of the cylinder 5 when the crank angle is 360 degrees, that it is moved toward d when the crank angle exceeds 360 degrees to enter into the second cycle, and that it is moved toward a when the crank angle exceeds 540 degrees.

To achieve the above motions, the cam groove has ascending slopes from a to b, from b to c, from c to d, and from d to a, and has deep recesses at the changeover points a, b, c, and d so as to prohibit any movement in the opposite direction.

FIGS. 46 to 49 show another structure for raising and lowering the cylinder 3.

A vertical shaft 61 is mounted with two sliding cams 62 and 63 having respective saw-toothed end faces 62*a* and 63. To the outer sliding cam 63 is firmly secured a sleeve 65 having an annular ridge 64 that corresponds to the lock pin, with the ridge 64 being fitted in the cylinder groove.

In the foregoing, the abutment position of the abutting saw-toothed end faces of the two sliding cams can vary by the movement of the sliding cams. To provide control of the height of the cylinder by way of the ridge 64, the confronting saw-toothed end faces may be formed such that the cam 63 lies at its lower position in the first cycle but that the cam 63 lies at its higher position in the second cycle.

Figure 50:
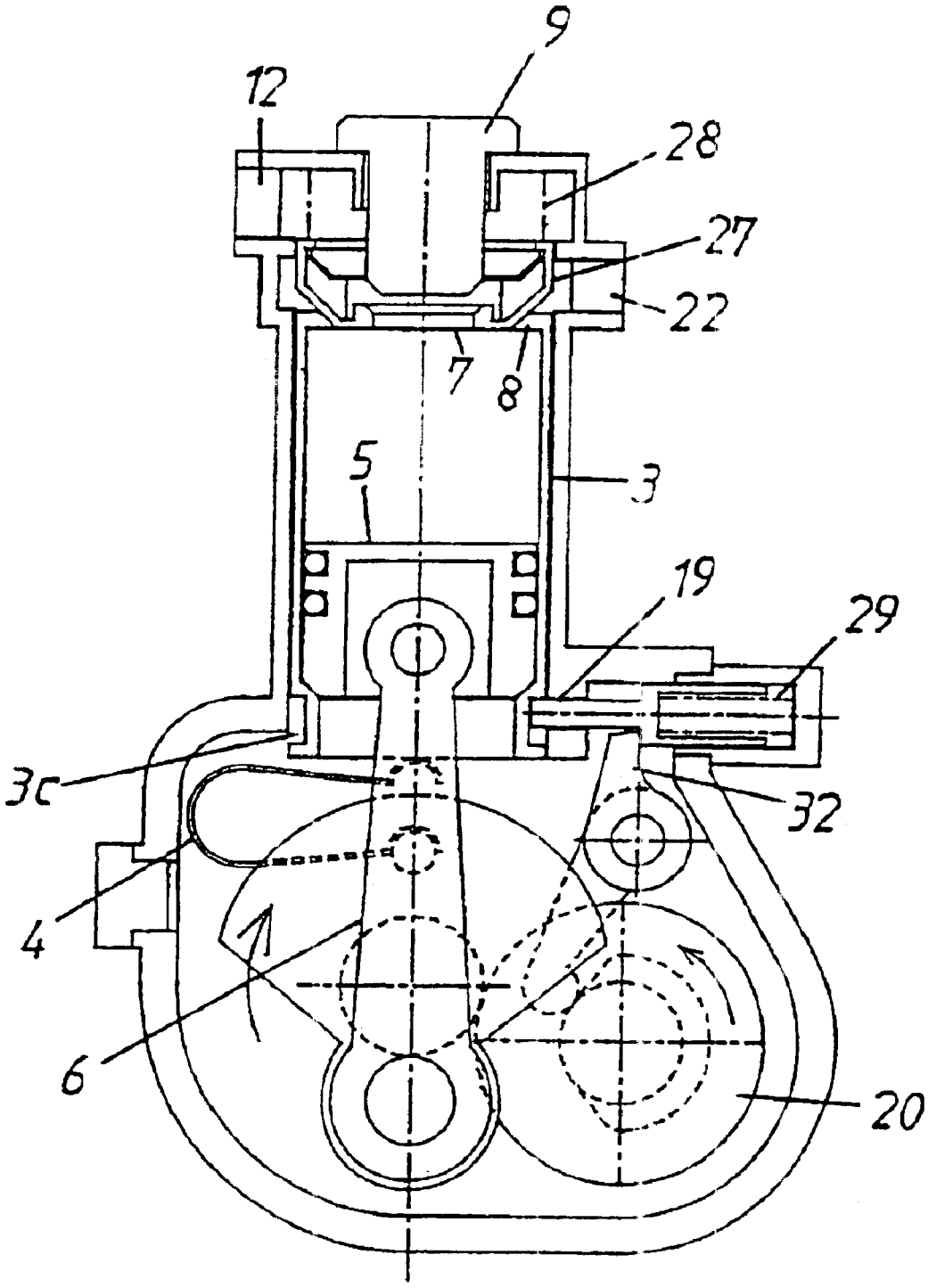
FIG. 50 is a sectional view of an exemplary use of a U-shaped spring as a cylinder spring.

FIG. 50 shows another example of the cylinder spring 4, which is appropriately applicable to the above embodiments.

The cylinder spring 4 is in the form of a U-shaped spring which has one end fitted to the crank 6 and the other end in press-contact with the lower end of the cylinder 3, so as to urge the cylinder 3 upward.

In this connection, the lock pin 19 is urged toward the cylinder by the spring 29 in FIG. 50, with a stopper cam 32 provided to control the advance or retreat of the lock pin 19.

Herein, the receiving groove 3*c* formed in the cylinder 3 has a larger width than the thickness of the lock pin so as to form a play in the vertical direction. The presence of the play allows the cylinder 5 to slightly rise together with the piston upon the exhaust so that the gap between the top surface of the piston and the valve disc 9 can be minimized to enhance the exhaust effect.

Note that, since the lock pin 19 may possibly be damaged if the piston 5 abuts against the top surface of the cylinder, the amount of play (groove width) should be determined so that the two cannot be in abutment against each other.

Figure 51:
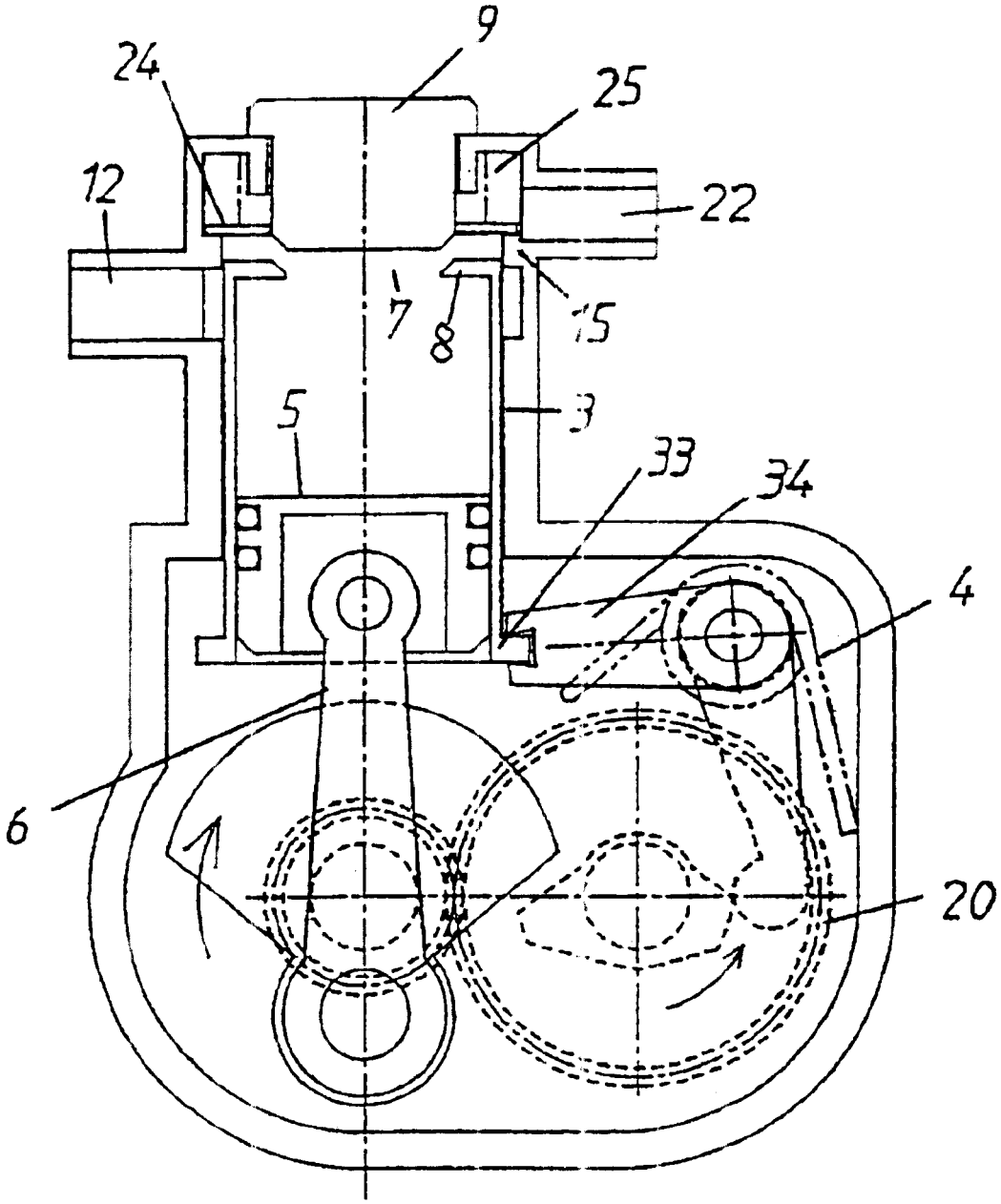
FIG. 51 is a sectional view showing an example of a cam-controlled cylinder.

FIG. 51 shows the cam-operated movement of the cylinder, without using the direct operation by the piston. It will be understood that the cylinder or the lock pin could be operated by use of known mechanical structures such as an appropriate cam structure, or clutch mechanism and disengaging mechanism, in addition to the structures described hereinbelow.

Referring to FIG. 51, the cylinder 3 has at its lower end a locking raised portion 33 to which is fitted the extremity of a control cam 34.

The control cam 34 is urged upward by a torsion spring acting as the cylinder spring 4. The control cam 34 is linked with the shaft of the crank 6 by way of the interlocking mechanism 20 which includes gears and cams, to ensure that the control cam 34 is held at a predetermined position shown in FIG. 51 in the first piston cycle and that the control cam 34 is rotated upwardly by the spring force of the cylinder spring 4 in the second piston cycle, such that the locking raised portion 33 of the cylinder 3 is pushed up by the control cam 34.

The control cam may be configured as being electrically controlled, in lieu of the mechanical control.

By controlling the rise and fall of the cylinder by the action of the control cam in this manner, it is possible to arbitrarily set the crank angle and the cylinder position.

Control of the cylinder position by the control cam enables the lower end of the cylinder to lie below the bottom dead center of the piston. The selector valve for suction/exhaust can thus have a simplified structure.

Referring to FIG. 51, the outlet 22 is disposed at the upper portion of the engine body. The valve disc 9 is level with and faces the vicinity of the lower end of the outlet 22, and the inlet 12 is formed below the valve disc 9, with the annular selector valve 24 being supported by the raised portion 15 positioned at the lower end of the outlet 22.

In this case, the control cam 34 is controlled by the cam of the interlocking mechanism 20, so as to achieve the motions that follow.

At 0-degree crank angle where the piston 5 is at its bottom dead center (FIG. 51), the cylinder 3 lowers, the selector valve 24 closes and the inlet 12 is closed by the peripheral wall of the cylinder 3.

Figure 52:
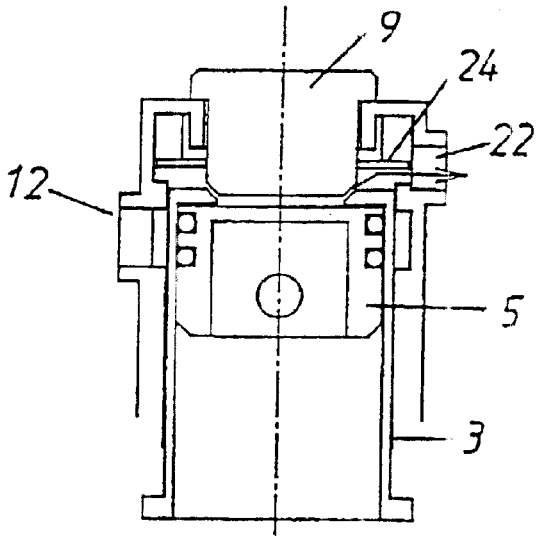
FIG. 52 is an explanatory diagram showing the state of a crank angle of 180 degrees of the same.

When the piston 5 rises, the cylinder 3 can rise to a slight extent in order to permit the rise of the piston 5 as far as possible but remains at its lower position. At that time, the resilient gas is pressed out by the rise of the piston, allowing the selector valve to ascend to open the outlet 22 (FIG. 52).

Figure 53:
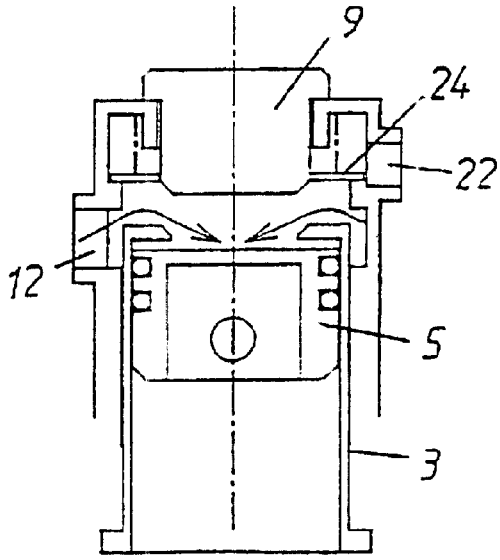
FIG. 53 is an explanatory diagram showing the state of a crank angle of 230 degrees of the same.
Figure 54:
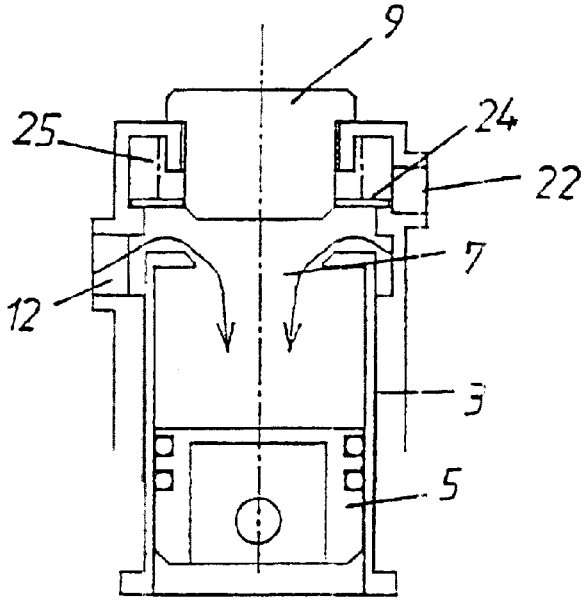
FIG. 54 is an explanatory diagram showing the state of a crank angle of 360 degrees of the same.

Upon the inflow of the fluid where the piston 5 descends, the cylinder 3 is lowered so that its upper end goes down below the inlet 12 to open the inlet 12, through which fresh air flows into the cylinder 3. At that time, a lower cylinder internal pressure causes a descent of the selector valve 24 to close the outlet 22 (See FIG. 53 depicting the state of 230-degree crank angle, and FIG. 54 depicting the state of 360-degree crank angle).

Figure 55:
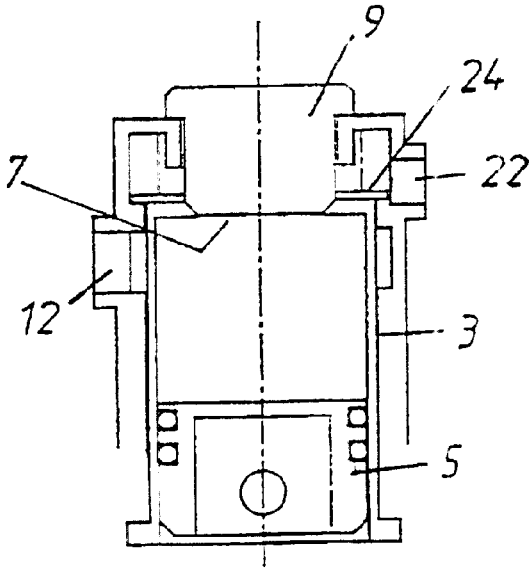
FIG. 55 is an explanatory diagram showing the state of a crank angle of 405 degrees of the same.
Figure 56:
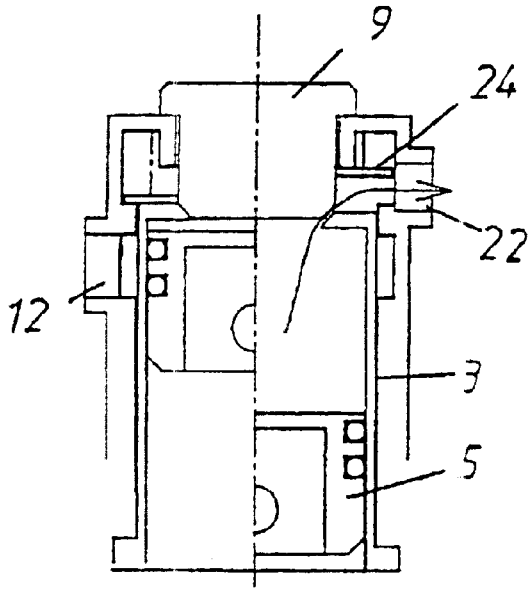
FIG. 56 is an explanatory diagram showing the state of crank angles of 540 degrees (left hand) and of 675 degrees (right hand) of the same.

When entering the second cycle, the cylinder rises and the inlet 12 closes, while simultaneously the opening 7 is closed and the outlet 22 closes, entering into the compression cycle (See FIG. 55 depicting the state of 405-degree crank angle). Subsequently, the fuel is ignited near the crank angle of 540 degrees, with the result that the cylinder internal pressure increases to press down the piston and the resultant exhaust pressure causes an ascent of the selector valve 24 to open the outlet 22. The cylinder 3 then lowers and returns to the state of 0-degree crank angle.

Figure 57:
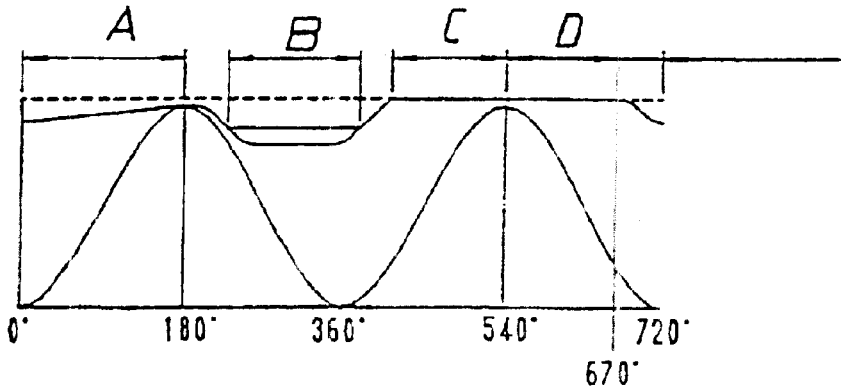
FIG. 57 is a diagram showing a relationship between the cylinder position and the crank angle of the same.

FIG. 57 shows the relationship between the positional motion of the cylinder lower end and the crank angle in the foregoing, in which A, B, C and D denote exhaust, suction, compression and combustion steps, respectively.

Best Mode 7 for Carrying out the Invention

Figure 58:
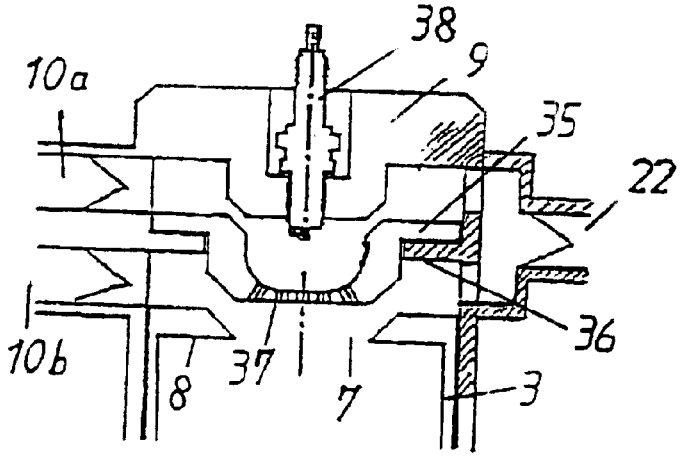
FIG. 58 is a sectional view showing a best mode 7 of the present invention.

FIG. 58 shows the inlet passage which is separated by the intervention of an auxiliary valve disc 35 into an inlet passage 10*a* which opens above the auxiliary valve disc 35 for suction of a thick mixture gas and an inlet passage 10*b* which opens below the auxiliary valve disc 35 for suction of a thin mixture gas. The auxiliary valve disc 35 and the valve disc located above the auxiliary valve disc 35 make up a valve disc of the present invention for blocking the opening 7 of the cylinder.

The engine body is provided with a seat 36 for the auxiliary valve disc 35 which intervenes between the upper end face of the cylinder 5 and the valve disc 9, with the auxiliary valve seat 35 being provided with a vent port 37. An igniter 38 is fitted to the valve disc 9.

The specific construction associated with the rise and fall of the cylinder and piston can appropriately be those shown in the above embodiments.

Herein, when the cylinder 5 rises, the valve seat 8 of the cylinder comes into abutment against and presses up the auxiliary valve disc 35, whose top surface in turn abuts against the valve seat 9 to hermetically seal the interior of the cylinder.

In this case, the space above the auxiliary valve disc 35 leads to the inlet passage 10*a* into which the thick mixture gas flows, and hence the space above the auxiliary valve disc 35 is filled with the thick mixture gas susceptible to ignite and can easily ignite.

Therefore, even the thin mixture gas can stably be ignited and burned, enabling the generation of NO, or other noxious gas to be suppressed.

Best Mode 8 for Carrying out the Invention

Figure 59:
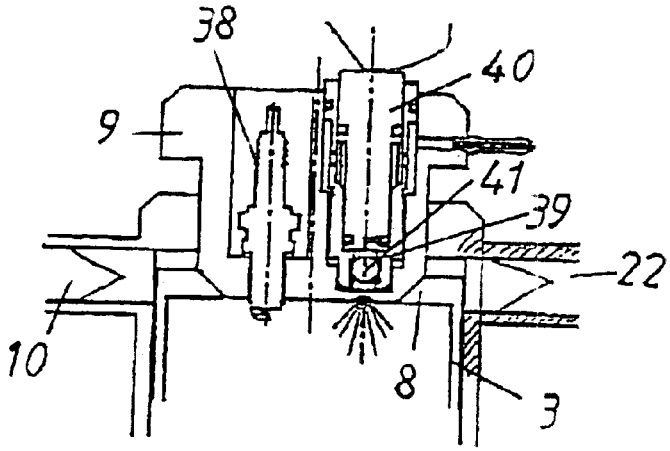
FIG. 59 is a sectional view showing a best mode 8 of the present invention.
Figure 60:
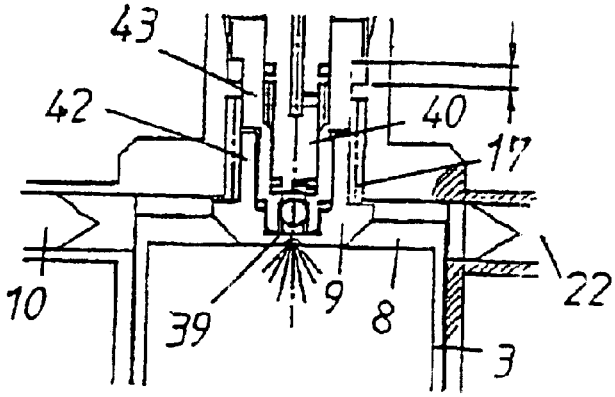
FIG. 60 is a sectional view showing a best mode 8 of the present invention.
Figure 61:
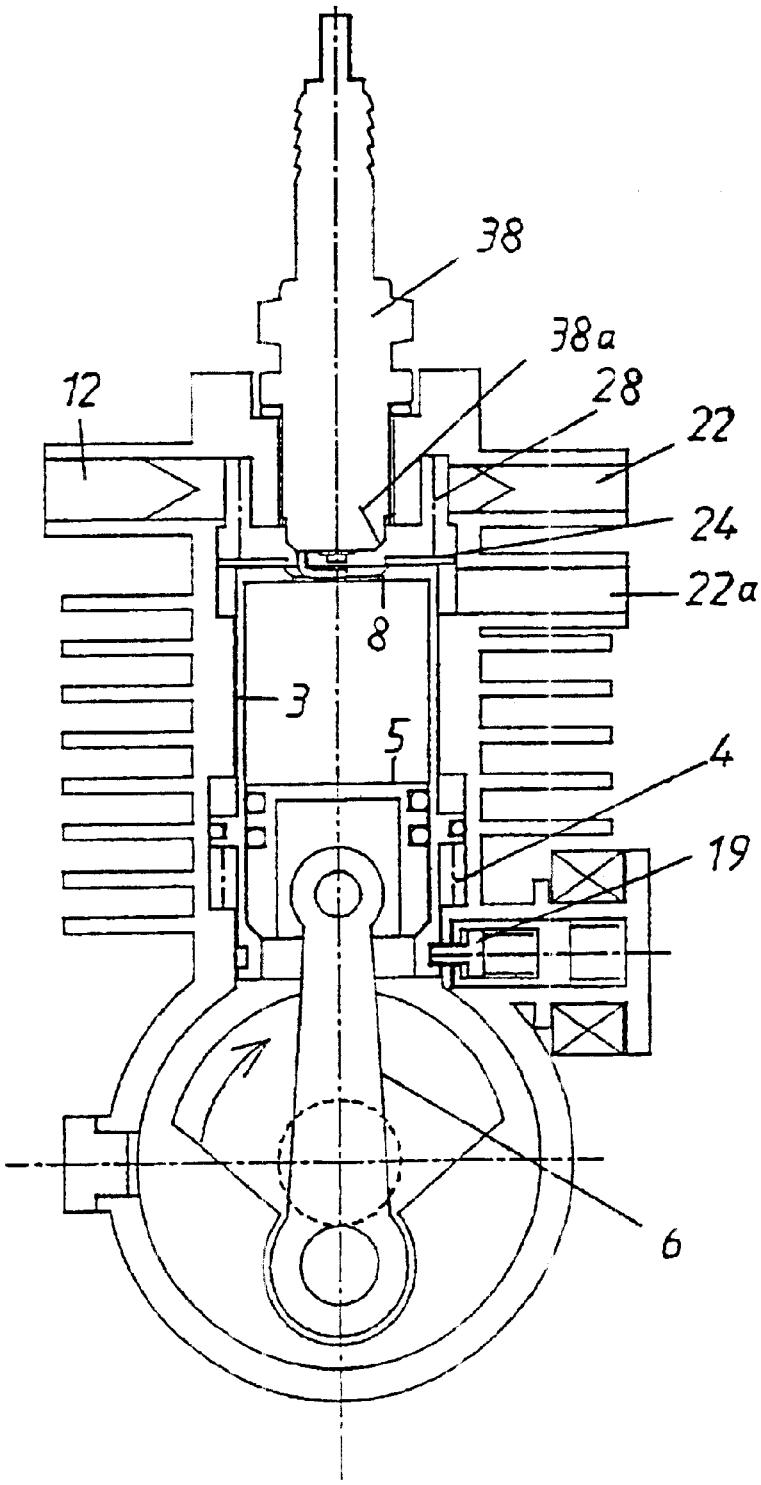
FIG. 61 is a sectional view showing an embodiment which employs an igniter itself as a valve disc.

FIGS. 59 to 61 show an application of the present invention to a fuel direct injection engine such as a diesel engine, in which the valve disc 9 is mounted with a nozzle for directly delivering fuel under pressure to the interior of the cylinder. This embodiment can also employ the rise and fall structure of the cylinder.

Referring to FIG. 59, the valve disc 9 is mounted with the igniter 38 and a fuel nozzle 39.

The fuel nozzle 39 is made up of a plunger 40 and a check valve 41 which move upward or downward in synchronism with the motion of the piston 5 (e.g., which may be interlocked with a cam mechanism or an electrical mechanism such as a solenoid), such that fuel can be injected from the nozzle 39 when the interior of the cylinder 3 is blocked as a result of abutment of the valve seat 8 against the valve disc 9.

FIG. 60 shows another example of the fuel nozzle 39 in a direct cylinder injection engine, in which the plunger 40 of the fuel nozzle is moved upward or downward by the rise or fall of the valve disc 9, to thereby eliminate the need for the interlocking mechanism in the example of FIG. 59.

The plunger 40 is loosely fitted to the upper side of the valve disc 9 in such a manner that a shoulder 43 of the plunger 40 is abutted against a shoulder 42 of the valve disc 9, the valve disc 9 being biased downward by the valve spring 17.

This arrangement allows the valve disc to lower when the cylinder 3 moves downward, as a result of which the plunger 40 also lowers to close the check valve 41 so that no fuel is injected. When the cylinder moves upward to thrust up the valve disc 9, the plunger also rises to open the check valve along with generation of fuel pressure so that fuel is injected through an injection port formed in the valve disc 9.

It will be understood that the igniter 38 may be provided as in FIG. 59.

As is apparent from FIGS. 58 to 60, the valve disc 9 has a larger area in the present invention so that the valve disc 9 is fitted with the igniter, fuel injection nozzle, etc.

FIG. 61 shows use of the igniter itself as the valve disc. A body lower end face 38*a* of the igniter 38 serves as a valve disc corresponding in size and shape to the valve seat 8.

In the present invention, a raised cylinder internal pressure causes an increased press-contact force between the valve seat and the valve disc, leading to less need for accuracy of intimate-contact between the valve seat and the valve disc. It will therefore be required for use as the valve disc only to shape the extremity of the existing ignition plug so as to correspond to the valve seat. It is thus possible to obtain a practical engine without needing any precise machining, even in the case of an engine having a smaller cylinder diameter.

Best Mode 9 for Carrying out the Invention

Figure 62:
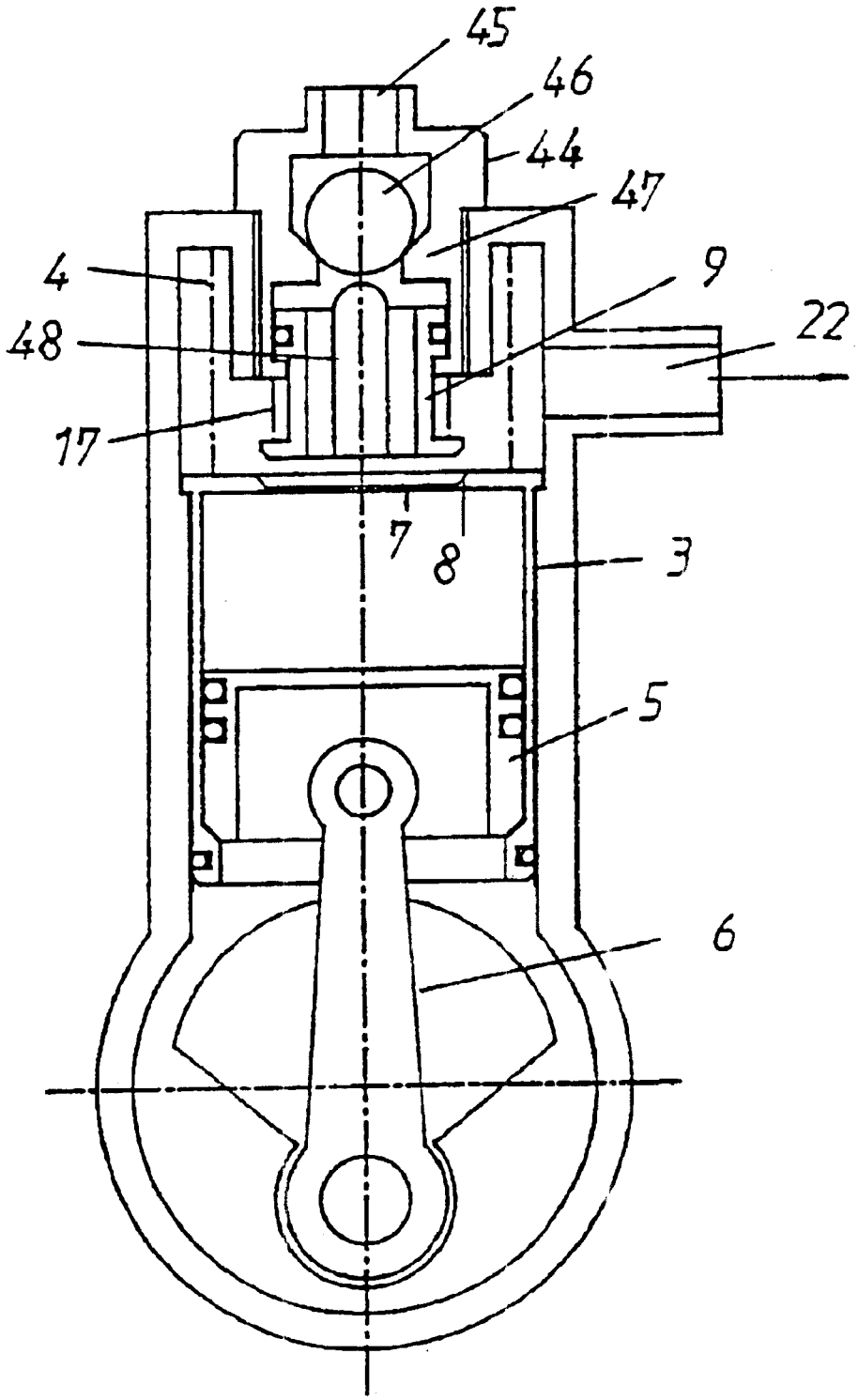
FIG. 62 is a sectional view showing a best mode 9 of the present invention.
Figure 63:
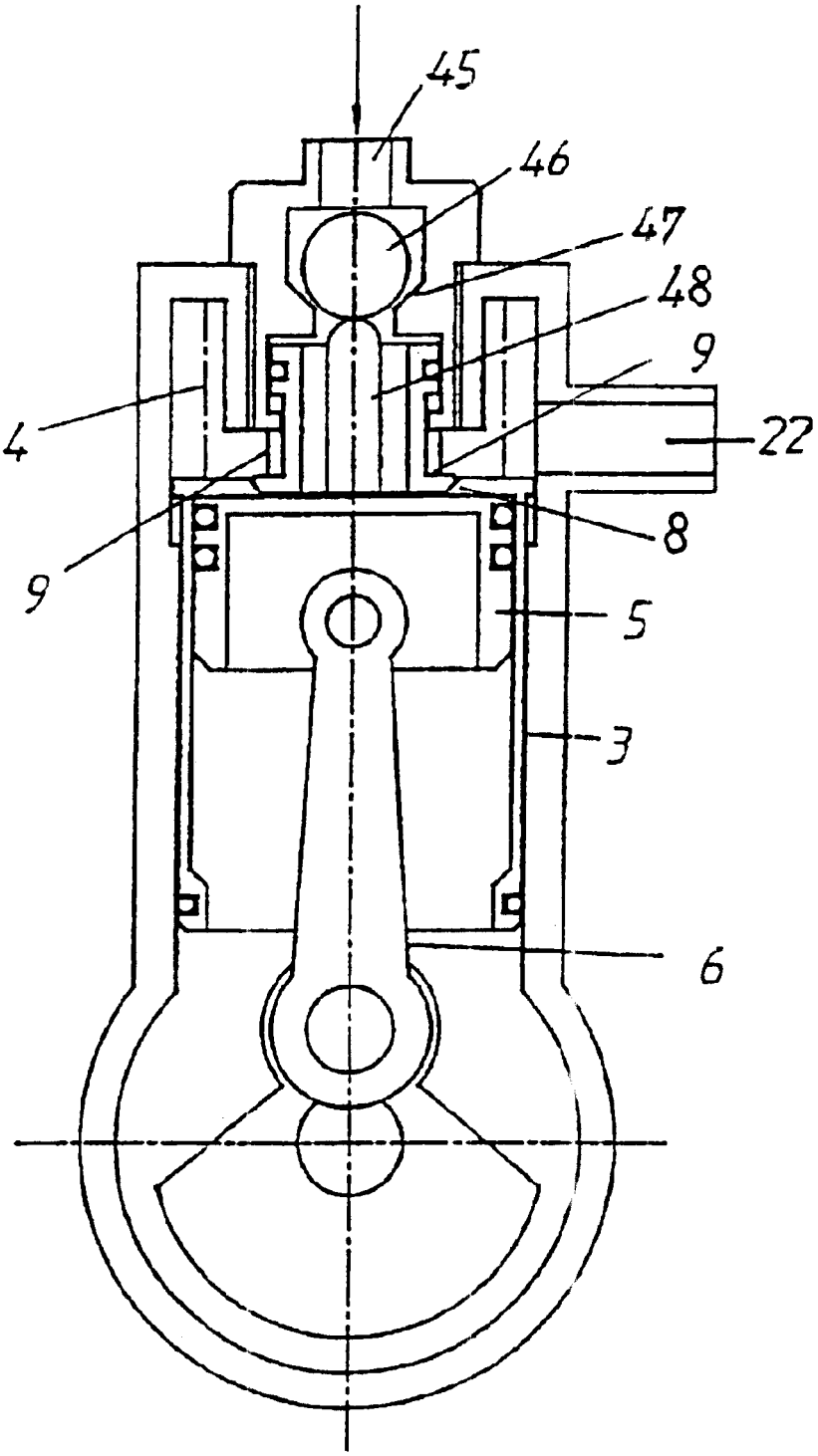
FIG. 63 is a sectional view showing the state of inflow of the same.

FIGS. 62 and 63 show an application of the present invention to a pressure fluid engine (external combustion engine). The pressure fluid can include various pressure or transmission fluids, such as pressurized oil, pressurized air, or steam.

In the diagram, a cap 44 of the engine body is provided with an inlet 45 for pressure fluid, below which is disposed a spherical auxiliary valve disc 46 that rises and lowers. The valve disc 9 is mounted below a valve seat 47 for the auxiliary valve disc 46 in such a manner that the valve disc 9 can rise and lower, with the valve disc 9 being urged downward by the valve spring 17.

The valve disc 9 is provided with an air passage that allows communication between spaces above and below the valve disc 9, and with a protuberance 48 adapted to thrust up the auxiliary valve disc 46 to open the valve when the valve disc 9 rises.

The cylinder is urged downward by the cylinder spring 4.

In this embodiment, FIG. 62 shows the piston 5 lying at its bottom dead center, the cylinder 3 being lowered together with the piston. Thus, the opening 7 of the cylinder 3 is opened so that the fluid within the cylinder is discharged through the outlet 22.

At that time, the valve disc 9 is lowering, and hence the spherical auxiliary valve disc 46 lowers and abuts against the valve seat 47 to close the valve so that no pressure fluid flows in.

The piston 5 thus moves to its top dead center by the action and inertia of unbalanced weight.

FIG. 63 shows the piston lying at its top dead center. At that time, as a result of the rise of the piston 5, the cylinder 3 overcomes the cylinder spring 4 for ascent, and the valve seat 8 abuts against the valve disc 9 to close the opening 7 so that the cylinder 3 and the outlet 22 are both shut off. In connection with this, the protuberance 48 of the valve disc 9 thrusts up the spherical auxiliary valve disc 46 for separation from the valve seat 47, thus opening the valve.

The pressure fluid therefore flows through the flow passage formed in the valve seat into the cylinder 3, pressing down the piston 5.

Upon the inflow of the pressure fluid in the foregoing, the internal pressure of the cylinder 3 goes up together with the rise of the pressure thrusting up the valve disc 1 by the cylinder 3, so that there is no possibility of the pressure fluid within the cylinder leaking out, similarly to the embodiments of the above engines.

When the piston lowers under the action of the pressure fluid, the cylinder 3 is pressed and moved downward by the piston, returning to the state of FIG. 62.

The protuberance 48 may be formed on the cylinder or the piston.

According to this embodiment, the inflow of the pressure fluid into the cylinder 3 continues until the piston reaches the vicinity of the bottom dead center. In conjunction with a further improved valve blocking state, as a function of the increased cylinder internal pressure, which is featured in the present invention, the pressure of the pressure fluid can act on the piston for a period of time as long as possible, to thereby obtain an external combustion engine having high output with less energy loss.

Figure 46:
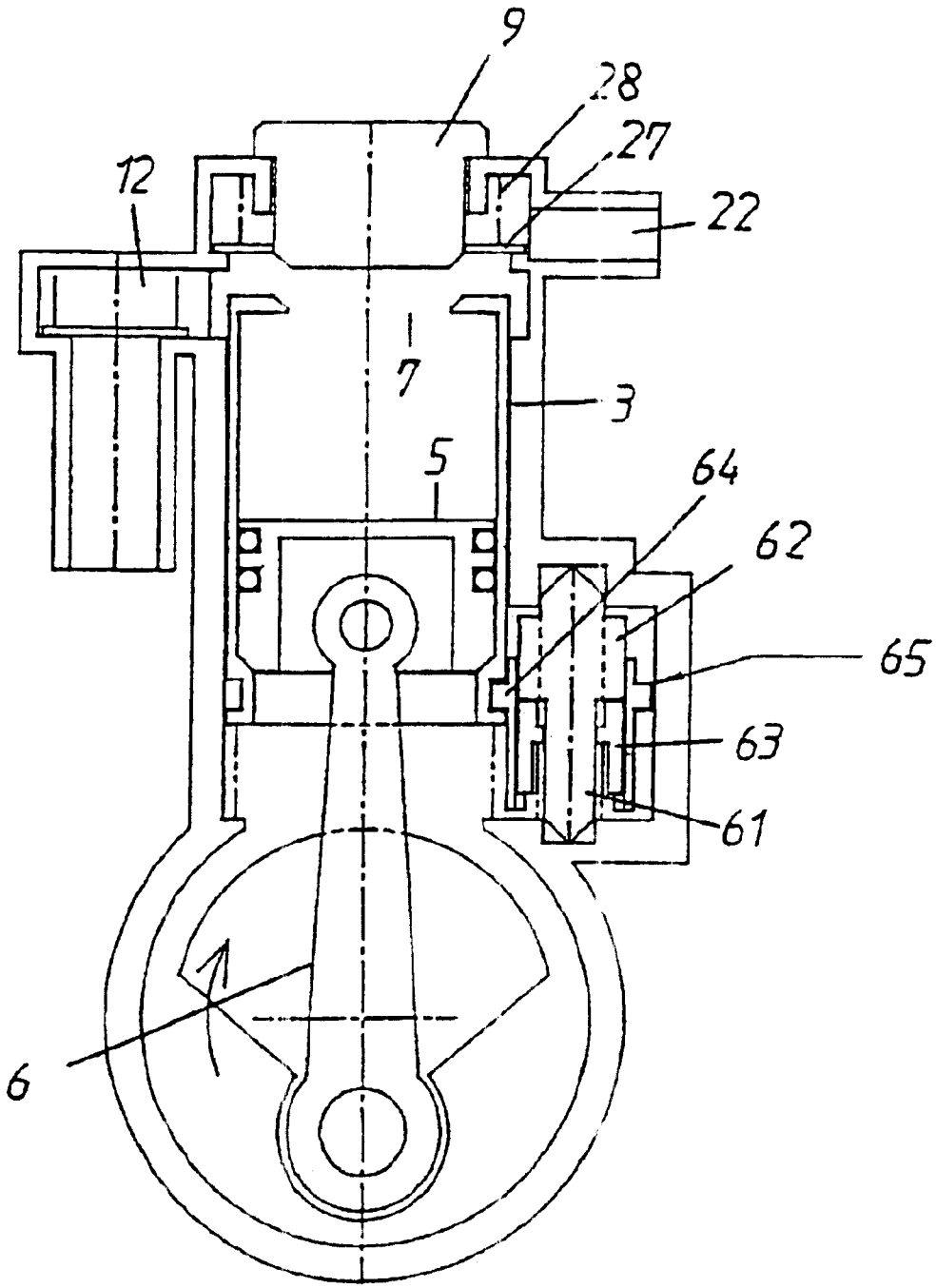
FIG. 46 is a sectional view showing another example of the lock pin control.
Figure 47:
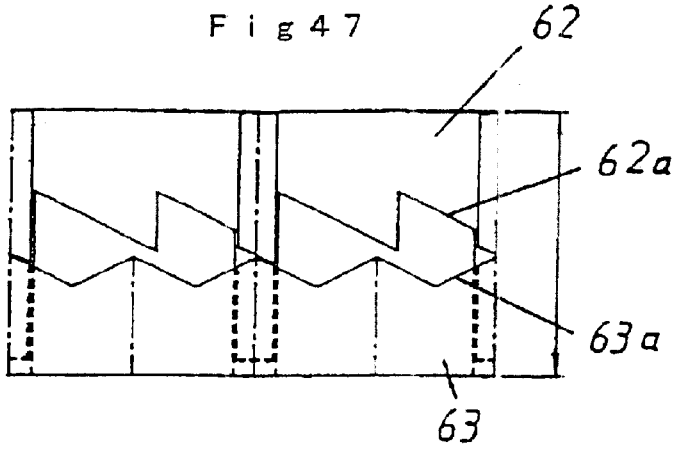
FIG. 47 is an explanatory diagram showing a relationship between two sliding cams.
Figure 48:
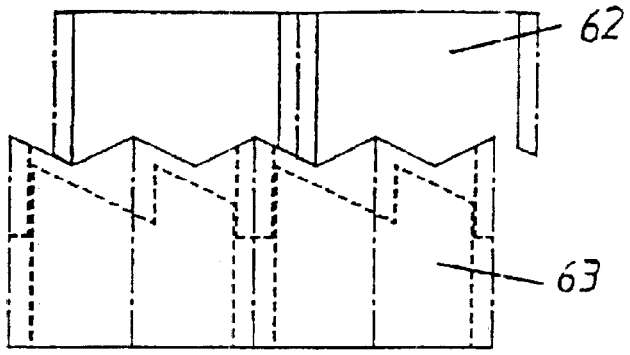
FIG. 48 is an explanatory diagram showing a relationship between two sliding cams.
Figure 49:
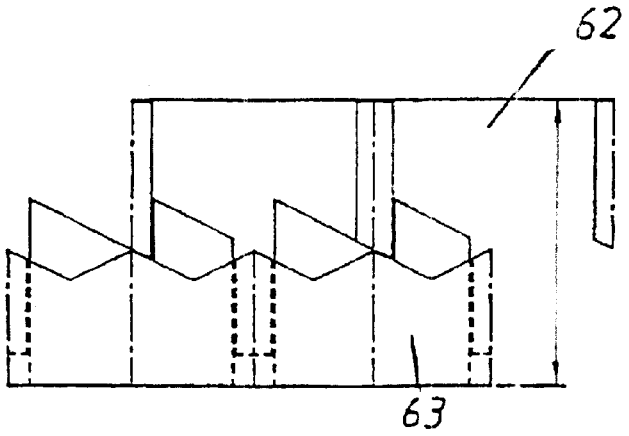
FIG. 49 is an explanatory diagram showing a relationship between two sliding cams.

According to this arrangement, as set forth hereinabove, the cylinder opening 7 is closed from immediately before the top dead center of the piston until immediately before the bottom dead center, so that the pressure fluid flows into the cylinder, during which time the pressure fluid can act on the piston. Thus, by employing a multi-cylinder engine having three or more cylinders and controlling the rise and fall of the cylinder so as not to allow the cylinder to be disengaged from the valve disc 9 as a result of release of pressure within the cylinder during the halt of operation (e.g., by using the controller for control of rise and fall of the cylinder as shown in FIG. 46), it is possible to start in always constant rotational direction through only the flow-rate control of the pressure fluid and to obtain an external combustion engine having a large torque with less energy loss. This feature could be used in engines for pollution-free lightweight vehicles that use compressed air as energy.

Figure 64:
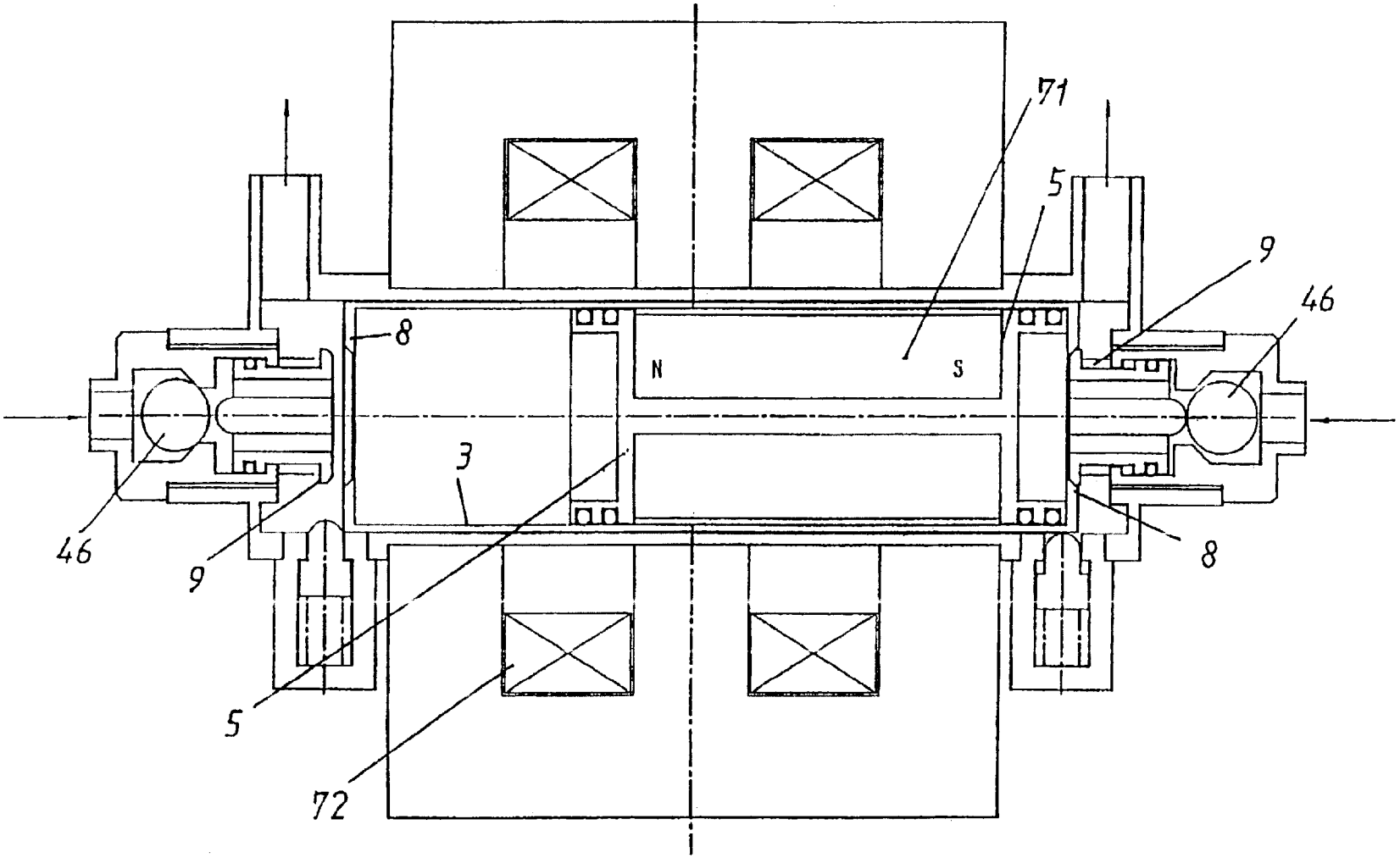
FIG. 64 is a sectional view showing an embodiment in the form of a double-acting engine.

FIG. 64 shows an application of the valve structure of FIGS. 62 and 63 to a double-acting engine (generator).

The valve seats 8 are disposed at both ends of the cylinder 3, with the valve discs 9 confronting the associated valve seats 8, the spherical auxiliary valve discs 46 being opened or closed by the movement of the associated valve discs 9.

A twin-head piston 5 is mounted in the cylinder 3, with a magnet 71 being interposed between the two piston heads such that the magnet 71 reciprocates by the movement of the piston. A magnetic circuit and a coil 72 are arranged on the outer side of the cylinder 3 so that a voltage develops across the coil by the movement of the piston.

This engine also has valve operations similar to those of FIGS. 62 and 63.

REFERENCE EXAMPLE

Figure 65:
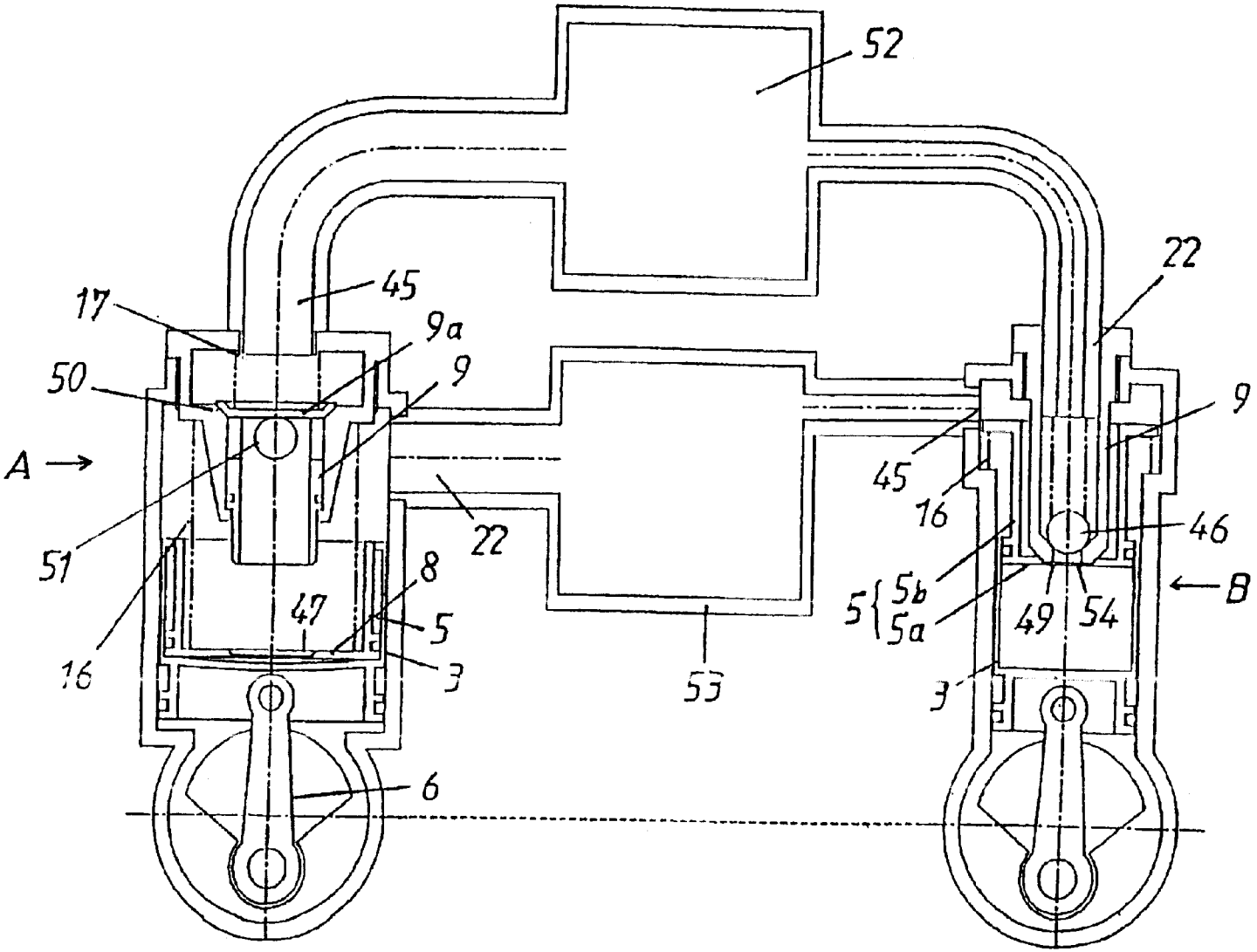
FIG. 65 is a sectional view showing a best mode 10 of the present invention.

In the external combustion engine, designated at A on the left side of FIG. 65, the valve seat 8 is disposed on the piston 5.

Referring to FIG. 65, the cylinder 3 is mounted in the engine body in such a manner as to be able to rise and lower. The cylinder 3 is linked to the crank 6 so that its rising or lowering motions are converted into rotational motions for output.

The piston 5 is mounted in the cylinder 3. The piston 5 has an opening 47 whose periphery defines the valve seat 8, the piston 5 being urged downward by the piston spring 16.

The engine body is provided with an inlet 45 for pressure fluid, below which the valve disc 9 is situated. The valve disc 9 is in the form of a tubular element whose top is blocked by a blocking plate 9*a*, the lower end portion of the valve disc 9 being adapted to abut against the valve seat 8 of the piston, the valve disc 9 being urged downwardly by the valve spring 17. Then, the periphery of the blocking plate 9*a* is arranged to abut a valve mounting seat 50 formed on the engine body such that it comes into abutment against the valve mounting seat 50 upon the lowering of the piston. The peripheral wall of the valve disc 9 is provided with an opening 51 for exhaust that opens into the outlet 22 of the engine body when the valve disc descends.

In the diagram, reference numeral 52 denotes a heater, and 53 denotes a cooler.

Herein, when the cylinder 3 is located at its bottom dead center as shown in the diagram, the piston 5 also lies at its lower position. Thus, the valve disc 9 is moved downward and the valve is blocked by the spring force of the valve spring 17 so that no pressure fluid flows in, the fluid within the cylinder being discharged through the opening 51 of the valve disc and the outlet 22 so that the cylinder 3 rises under the action of unbalanced weight and inertia.

A rise of the cylinder 3 causes a rise of the piston 5, with the result that the valve seat 8 comes into abutment against the valve disc 9 to thrust up the valve disc 9. A rise of the valve disc 9 causes a disengagement of the blocking plate 9*a* from the valve disc mounting seat 50, so that the inlet 45 is placed in fluid communication with the cylinder 3, allowing the pressure fluid to flow into the cylinder 3.

Since the cylinder 3 is pressed down as a result of inflow of the pressure fluid, the piston 5 is pressed down by the action of the piston spring 16, for disengagement from the valve disc 9. When the piston 5 descends, the valve disc 8 is moved downward by the action of the valve spring 17, whereupon the opening 51 is placed in fluid communication with the outlet 22 whilst the opening 51 is placed in fluid communication with the cylinder 3, thus allowing a discharge of the fluid within the cylinder and a return to the state of the diagram.

According to this embodiment, the cylinder itself is moved by the piston stroke, so that the guide distance can be increased in the same size of engine body, as compared with one having the crank linked to the piston. Thus, the fluttering is reduced, which is advantageous to a large-diameter cylinder in particular.

No fluid passages to the exterior lie between the pressure fluid inlet 45 and the valve disc mounting seat 50 and in the crankcase. When the internal pressure of the cylinder 3 goes up as a result of the inflow of the pressure fluid, the increased internal pressure moves the piston 5 upward, so that the valve seat 8 and the valve disc 9 are brought into a further press-contact, adding to the airtightness. Thus, there is less possibility that the pressure fluid will leak into the exterior of the cylinder, such as the crankcase, enabling design of an external combustion engine having a simpler structure and reduced energy loss.

Such reduced energy loss may be effective for the small-scale generation of electricity utilizing wave power or a volcano's erupted gases, making use of slight differences in pressure.

Best Mode 10 for Carrying out the Invention

An embodiment designated at B on the right side of FIG. 65 is an application of the present invention to the pump, in which are effected reverse actions to the engine A. More specifically, the outlet 22 is disposed at the top of the pump body, and the inlet 45 is disposed below the outlet 22. The cylindrical valve disc 9 has a bottom including an opening 54 and is mounted with a spherical auxiliary valve disc 46 for opening and closing the opening 54.

The piston 5 comprises a tubular portion 5*b* located above a base plate 5*a* having an opening 49, and the piston 5 is urged upwardly by the piston spring 16 mounted between the tubular portion 5*b* and the pump body.

In the state where the cylinder 3 lies at its bottom dead center as shown in the diagram, the piston 5 is urged upwardly by the piston spring 16, so that it is in abutment against the valve disc 9 with the auxiliary valve disc 46 lying at its lower position, so that the interior of the cylinder 3 is isolated from the exterior and the cylinder 3 rises by the action of unbalanced weight and inertia.

As a result of the rise of the cylinder 3, the fluid pressure within the cylinder 3 moves the valve 5 and the auxiliary valve disc 46 upwardly, so that the opening 54 is opened, allowing the fluid within the cylinder 3 to be discharged through the outlet 22.

When the fluid is discharged, the auxiliary valve disc 46 lowers to block the opening 54. At that time, fluid flows in at all times through the inlet 45 so that when the fluid pressure overcomes the spring force of the piston spring 16, the piston 5 is pressed down for disengagement of the valve seat 8 from the valve disc 9. The inlet 45 is thus placed in fluid communication with the cylinder 3 so that the fluid collects within the cylinder 3, which presses down the cylinder 3 to return to the state of the diagram.

Because there is no possibility that the pressure fluid within the cylinder will leak out to the exterior, this pump also makes even a fluid having small differences in pressure available, which may be effective for the pumps for air conditioning.

Combination of the engine A and the pump B as in FIG. 65 may be advantageous to application to the external combustion engine using other fluids than water and air, since the fluid can be circulated by first operating the engine A by pressure fluid heated by the heater 52, and then delivering the fluid used in the engine A to the pump B for the operation of the pump B.

Best Mode 11 for Carrying out the Invention

Figure 66:
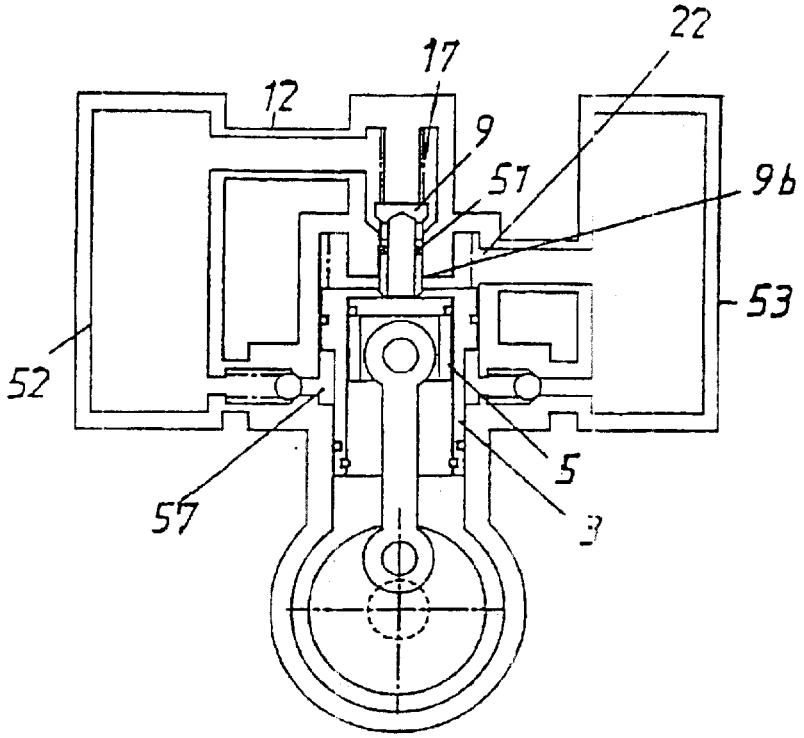
FIG. 66 is a sectional view showing a best mode 11 of the present invention.
Figure 67:
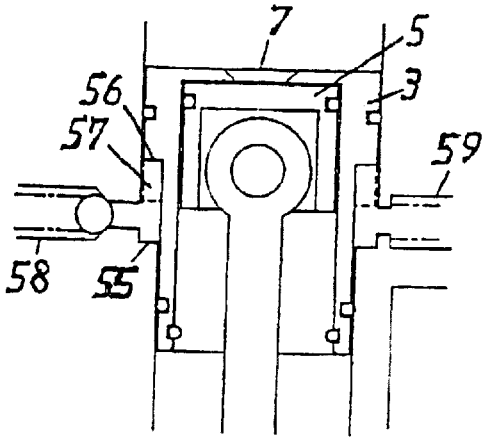
FIG. 67 is an enlarged sectional view of a cylinder of the same.
Figure 68:
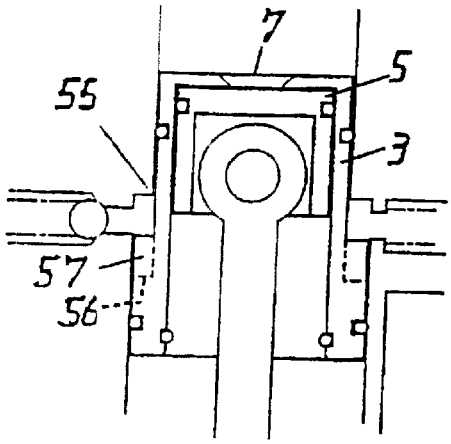
FIG. 68 is an enlarged sectional view of a cylinder in another mode of the same.

An embodiment of FIGS. 66 to 68 presents functions of both the engine and the pump of the above reference example and embodiment 10, respectively, by use of a single engine.

As shown in FIG. 67, the inner wall of the engine body has a lower portion whose diameter is reduced by way of a shoulder 55, and the outer wall of the cylinder 3 has a lower portion whose diameter is reduced by way of a shoulder 56 such that a pump chamber 57 is formed between the outer wall of the cylinder 3 and the inner wall of the engine. The volume of the pump chamber 57 increases when the cylinder 3 rises but reduces when the cylinder 3 lowers. The engine body comprises the pump chamber 56, the heater 52, the cooler 53 and communication passages 58 and 59.

The construction of the valve disc 9 is the same as that in the reference example.

Herein, when the piston 5 shown in the diagram lies at its top dead center, the valve disc 9 is at its upper position so that spaces above the cylinder 3 are placed in fluid communication with one another by way of the inlet 12, the valve disc opening 51 and the tubular portion 9*b* of the valve disc 9, with the valve disc opening 51 and the outlet 22 being closed. Thus, fluid within the system heated and expanded by the heater 52 flows into the spaces above the cylinder 3 to press down the piston 5. When the piston 5 moves downward, so that its lower end abuts against the shoulder at the lower portion of the cylinder, the cylinder 3 is pressed down by the piston 5 and is lowered together with the piston 5, reaching its bottom dead center.

Since the valve disc 9 is at its lower position when the cylinder 3 descends, the space between the inlet 12 and the cylinder 3 is blocked and the cylinder 3 is placed in fluid communication with the cooler 53 by way of the outlet 22. The lowering of the cylinder 3 reduces the volume of the pump chamber 57. In consequence, the fluid residing in the pump chamber 57 is pressed out of the pump chamber 57 into the heater 52 for heating. For this duration, the piston 5 and the cylinder 3 are raised by the action of unbalanced weight and inertia, adding to the volume of the pump chamber 57. Since the valve disc 9 is at its lower position in the rising stroke of the cylinder 3, a cooled fluid displaced by the heated fluid flows from the cooler 53 into the pump chamber 57, returning to the state of the diagram.

FIG. 68 shows the opposite case to the above, in which the inner wall of the engine body has a lower portion whose diameter is enlarged by way of a shoulder 55, with the outer wall of the cylinder 3 having a lower portion whose diameter is enlarged by way of a shoulder 56, such that the pump chamber 57 is formed between the outer wall of the cylinder 3 and the inner wall of the engine body.

In this construction, the volume of the pump chamber 57 increases upon the rise of the cylinder 3 but decreases upon the fall.

Best Mode 12 for Carrying out the Invention

Figure 69:
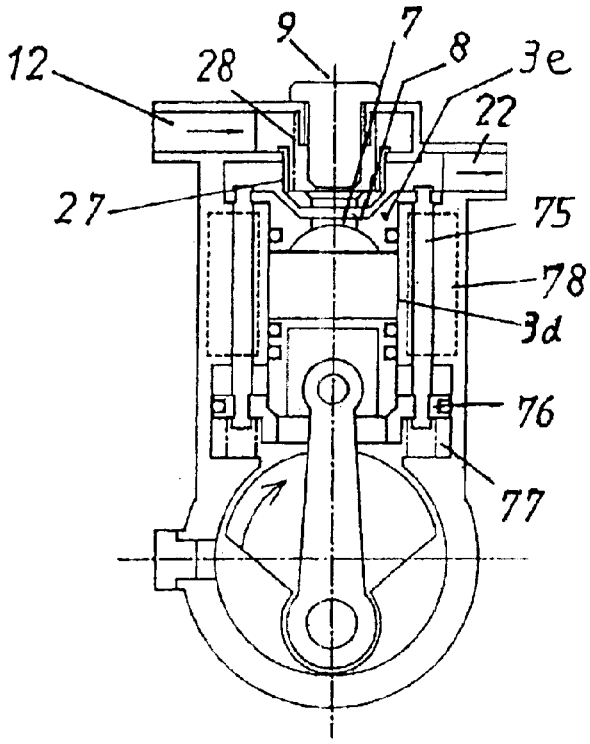
FIG. 69 is a sectional view showing a best mode 12 of the present invention.

FIG. 69 shows a two-cycle engine, having a cylinder 3 which includes a cylindrical cylinder body 3d and a cylinder end face element 3e provided with the opening 7 and the valve seat 8 and mounted on the upper end portion of the cylinder body 3*d* in such a manner as to be able to rise and fall.

The cylinder body 3*d* is firmly secured to the engine body. The cylinder end face element 3*e* is fitted to the cylinder body 3*d* in an airtight manner such that the airtightness with the cylinder body 3*d* is not lost even when the pressure is in the process of rising.

The cylinder end face element 3*e* is linked to an actuator 76 by means of a rod 75. The actuator 76 is urged upwardly by a spring 77 so that, upon the lowering of the piston 5, the actuator 76 is pressed and moved downwardly by the piston, and that upon the rise of the piston 5 it is raised by the spring force of the spring 77.

In the state where the piston lies at its bottom dead center as shown in the diagram, the actuator 76 is lowering, and hence the cylinder end face element 3*e* linked via the rod 75 to the actuator 76 moves downwardly, with the valve seat 8 formed in the cylinder end face element 3*e* being disengaged from the valve disc 9, placing the cylinder 3 and the outlet 22 in fluid communication with each other for scavenging.

When the piston 5 rises, the actuator 76 ascends together with the piston for a little while until the valve seat 8 abuts against the intermediate valve 27 to close the outlet 12 so that only the inflow continues. When the piston further rises, the cylinder end face element 3*e* thrusts up the intermediate valve 27 with the aid of the spring force of the spring 77 until the abutment against the valve disc 9, with the result that the inlet 12 is also closed, allowing entry into the compression stroke. Then, fuel is ignited in the vicinity of the top dead center of the piston and the cylinder internal pressure goes down, returning to the state shown in the diagram.

In this construction, the cylinder body 3*d* is immobile so that there is no need for the gap for cylinder movement between the cylinder body and a cooling water passage 78, which is advantageous in obviating any reduction of the cooling efficiency.

Although the above description has been made in terms of the construction of the two-cycle engine, the same will apply to the four-cycle engine. The cylinder end face element 3*e* and the actuator 76 may be raised or lowered with the air of a mechanism for lifting and lowering the rise-and-fall type cylinder shown in the above embodiments, including utilization of the lock pin 19.

REFERENCE EXAMPLE

Making the cylinder as well as the piston movable, as in the present invention, can simplify the structure of the so-called displacer-type Stirling engine.

Although the Stirling engine has variously been proposed since old times, it has been recently reevaluated for enhancing engine efficiency and for promoting non-polluting properties.

The displacer-type Stirling engine is arranged such that a flow passage for gas or other fluids connects, via a heat exchanger, opposite ends of the displacer cylinder so that cool air or warm air is introduced into a displacer cylinder by movement of a displacer piston mounted in the displacer cylinder, with gas in the system being delivered from the displacer cylinder to the upper portion of a power cylinder, the gas raising and lowering a power piston mounted in the power cylinder, for acquisition of power.

Accordingly, the conventional displacer-type Stirling engine has necessitated two separate cylinders, normally, the displacer cylinder and the power cylinder, as well as two cranks.

It would become possible, however, to drive the displacer-type Stirling engine by use of a single crank by making the cylinder as well as the piston movable. Although the fluid is expressed as a gas thereafter, any liquid would be available instead of the gas.

Figure 70:
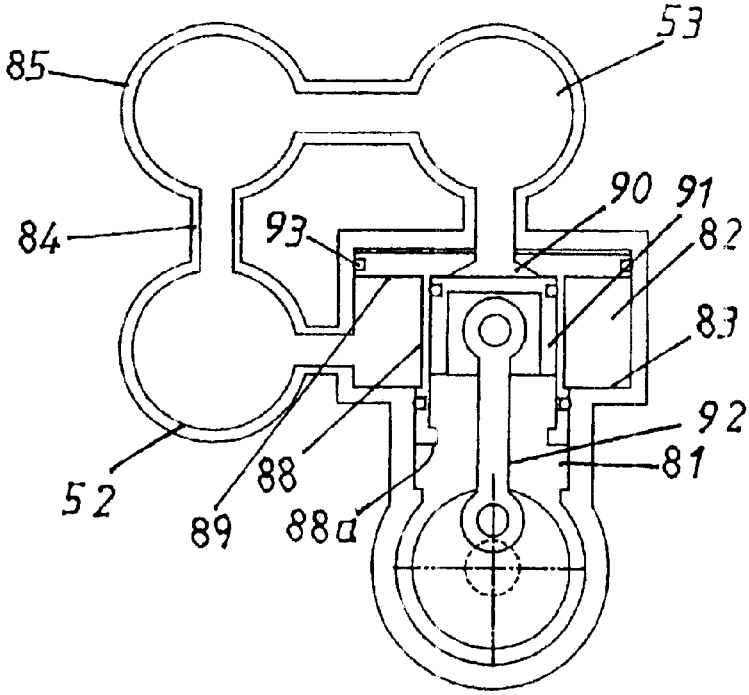
FIG. 70 is a sectional view showing an example of a Stirling engine.

Referring to FIG. 70, a reduced-diameter portion 81 acting as a cylinder is formed at a lower portion within the internal space of the engine body, with an enlarged-diameter portion 82 being formed at an upper portion thereof, with a shoulder 83 defined between the reduced-diameter portion 81 and the enlarged diameter portion 82.

A gas flow passage 84 connects the upper wall of the enlarged-diameter portion 82 and the lower side wall of the enlarged-diameter portion 82. The gas flow passage 84 is provided with the cooler 53, a heat exchanger 85 and the heater 52, in the order mentioned above, so that cool air and warm air are supplied from the upper portion and the lower portion, respectively, of the enlarged-diameter portion 82.

The reduced-diameter portion 81 is mounted with a cylinder 88 that is able to freely rise and fall, the cylinder 88 having at its upper end a displacer piston 89 integrally formed therewith. The displacer piston 89 has a through hole 90 formed at the center thereof. The cylinder 88 has a locking portion 88*a* formed at the inner side of the lower end. Then, the displacer piston 89 is allowed to move vertically through the enlarged-diameter portion 82.

The cylinder 88 is mounted with a power piston 91 to which a crank 92 is linked.

In the foregoing, a piston ring 92 for sealing is mounted on the displacer piston 89. The piston ring 93 induces a frictional resistance against the inner wall of the enlarged-diameter portion of the engine body so that a mere movement of the power piston 91 within the cylinder 88 cannot cause a movement of the displacer piston 89.

The above Stirling engine operates as follows.

From the theoretical characteristics of the Stirling engine, it is understood that the gas flow passage 84 is regarded theoretically as not having any resistance at all, so that constantly equal pressures are applied on the top and bottom of the displacer piston irrespective of the pressure of the filled gas.

In the diagram, the displacer piston 89 and the power piston 91 are both situated at their respective top dead centers. At that time, gas within the gas flow passage 84 localizes on the side of the heater 52, whereupon the pressure within the gas flow passage 84 will go up due to the presence of gas heated by the heater. A force corresponding to the raised pressure acts on the top surface of the power piston 91 by way of the through hole 90, so that the power piston 91 is subjected to the downward force and lowers.

When the crank angle approaches 90 degrees as a result of lowering of the power piston 91, the lower end of the power piston 91 comes into abutment against the locking portion 88a of the cylinder 88, whereupon the cylinder 88 and the displacer piston 89 integral therewith move downward to reach their bottom dead centers.

A brake may be provided, if needed, in order to control the frictional force so as to keep the phase difference (about 90 degrees in the above) between the motion of the power piston 91 and the motion of the cylinder 88 interlocking therewith.

In the foregoing, as a result of lowering of the displacer piston 89, the space above the displacer piston 89 is increased but the space below the displacer piston 89 is reduced, so that the gas is moved toward the cooler 53. At that time, the heated gas imparts heat to the heat exchanger 85 and lowers its temperature prior to entry into the cooler 53.

Cooling of the gas in the system lowers the pressure within the gas flow passage 84, and a resultant suction force corresponding to the lowered pressure sucks and lifts the power piston 91. Then, in the vicinity of 270-degree crank angle, the upper end of the power piston 91 comes into abutment against the underside of the displacer piston 89, thrusting up the displacer piston.

Attendant on the rise of the displacer piston, the gas moves toward the heater and returns to the state of the diagram.

In terms of the gas movement, the gas imparts heat to the heat exchanger upon the movement from the heater side to the cooler side whilst the gas receives heat imparted to the heat exchanger upon the movement from the cooler side to the heater side. The quantity of heat applied by the heater and the quantity of heat extracted by the cooler are therefore reduced.

Then, since the displacer cylinder is integrated with the power cylinder, the length of the gas flow passage 84 can be minimized with less loss of heat.

The above construction allows an integration of the displacer cylinder and the power cylinder that have hitherto been arranged separately, achieving a simplification in mechanism and a reduction in size.

Then, the reduced length of the gas flow passage contributes to acquisition of an efficient Stirling engine having an improved responsibility in gas movement and a high energy density.

EFFECT OF THE INVENTION

According to the present invention, a suction/exhaust valve is disposed in an opening whose diameter is smaller than the diameter of the piston mounted in the cylinder or than the diameter of the cylinder. For this reason, the valve airtightness is enhanced as a function of increase of the cylinder internal pressure, so that a valve unit having a good airtightness can be obtained with a simple structure. Simultaneously, the area of the opening can be increased to the ultimate diameter of the piston so that an engine or motor having high exhaust efficiency can be obtained.

The valve disc provides control of the cylinder pressure in cooperation with the valve seat disposed in the cylinder or in the piston, whereupon there is no need for a gasket (which may suffer frequent failures) interposed between the cylinder head and the body, which may be seen in the conventional engine or pump.

Furthermore, in the internal combustion engine of the present invention, the rise and fall distance of the cylinder varies by varying the vertical position of the valve disc. Then, since the rise and fall distance of the piston is unvarying, the compression ratio within the cylinder becomes smaller when the valve disc is situated above to set the top dead center of the cylinder to a high position, whereas the compression ratio within the cylinder becomes larger when the valve disc is situated below to set the top dead center of the cylinder to a low position. That is, the valve disc is vertically moved so that the compression ratio within the cylinder can vary during the operation of the engine, thereby providing control of the combustion efficiency.

INDUSTRIAL APPLICABILITY

As set forth hereinabove, the valve unit of the present invention enables the suction/exhaust valve of the cylinder to be opened or closed in response to the motion of the piston with a simple structure and achieving high-efficiency operation due to the increased valve area, which allows various applications to the internal combustion engine and external combustion engine.

LIST OF REFERENCE NUMERALS AND CORRESPONDING ELEMENTS

| Reference Numeral | Element |
|---|---|
| 1 | engine |
| 2 | crankcase |
| 3 | cylinder |
| 3a | upper cylinder |
| 3b | lower cylinder |
| 3c | receiving groove |
| 3d | cylinder body |
| 3e | cylinder end face element |
| 4 | cylinder spring |
| 5 | piston |
| 5a | tubular portion of piston |
| 6 | crank |
| 7 | opening |
| 8 | valve seat |
| 9 | valve disc |
| 9a | blocking plate for valve disc |
| 10 | inlet passage |
| 11 | inflow pipe |
| 12 | inlet |
| 13 | outlet |
| 14 | raised portion |
| 15 | raised portion |
| 15a | shoulder |
| 16 | piston spring |
| 17 | valve spring |
| 18 | inflow chamber |
| 19 | lock pin |
| 19a | pin |
| 20 | interlocking mechanism |
| 21 | check valve |
| 22, 22a | outlet |
| 23 | rotary valve |
| 23a | body of rotary valve |

-continued

LIST OF REFERENCE NUMERALS AND CORRESPONDING ELEMENTS

| Reference Numeral | Element |
|---|---|
| 23b | valve disc of rotary valve |
| 24 | selector valve |
| 25 | valve spring |
| 26 | intermediate valve |
| 27a | flow passage |
| 28 | valve spring |
| 29 | spring of lock pin |
| 30 | block |
| 31 | cam groove |
| 32 | stopper cam |
| 33 | locking raised portion |
| 34 | control cam |
| 35 | auxiliary valve disc |
| 36 | seat for auxiliary valve disc |
| 37 | vent port |
| 38 | igniter |
| 39 | fuel nozzle |
| 40 | nozzle plunger |
| 41 | check valve |
| 42 | shoulder |
| 43 | shoulder |
| 44 | engine body cap |
| 45 | inlet |
| 46 | auxiliary valve disc |
| 47 | valve seat |
| 48 | protuberance |
| 49 | piston opening |
| 50 | valve disc mounting seat |
| 51 | opening |
| 52 | heater |
| 53 | cooler |
| 54 | opening |
| 55, 56 | shoulder |
| 57 | pump chamber |
| 58, 59 | communication passage |
| 61 | shaft |
| 62, 63 | sliding cam |
| 64 | ridge |
| 65 | sleeve |
| 66 | diaphragm |
| 67 | pump chamber |
| 68 | inflow pipe |
| 71 | magnet |
| 72 | coil |
| 75 | rod |
| 76 | actuator |
| 77 | spring |
| 78 | cooling water passage |
| 81 | reduced-diameter portion |
| 82 | enlarged-diameter portion |
| 83 | shoulder |
| 84 | gas flow passage |
| 85 | heat exchanger |
| 88 | cylinder |
| 89 | displacer piston |
| 90 | through-hole |
| 91 | power piston |
| 92 | crank |
| 93 | piston ring |

Statement Based on Article 19 of Treaty claim 1 makes clear that the movement of the cylinder is controlled by the piston.

Reference Cited (Japan Patent Laid-open Pub. No. Hei1-313608) discloses the cylinder which rises or falls by the action of the internal pressure of the cylinder (sleeve) and the balance of the spring, but not the arrangement that the cylinder is directly controlled by the movement of the piston.

Claim 2 is additional and is associated with the Best Mode 1 for Carrying Out the Invention (FIGS. 8 to 11) relating to the two-cycle cylinder exhaust internal engine.

Claim 3 clarifies the original claim 3 filed and is associated with the Best Mode 2 for Carrying Out the Invention (FIGS. 12 to 16) relating to the two-cycle cylinder separation exhaust internal combustion engine.

Claim 4 is additional and is associated with the Best Mode 2 for Carrying Out the Invention (FIGS. 12 and 16) relating to the crankcase separation scavenging pump.

Claim 5 clarifies the original claim 3 filed and is associated with the Best Mode 3 for Carrying Out the Invention (FIGS. 17 to 22) relating to the four-cycle cylinder exhaust internal engine.

Claim 6 clarifies the original claim 4 filed and is associated with the Best Mode 4 for Carrying Out the Invention (FIGS. 23 to 26) relating to the two-cycle top two-valve type internal combustion engine.

Claim 7 clarifies the original claim 7 filed and is associated with the Best Modes 5 to 7 for Carrying Out the Invention (FIGS. 27 to 57, FIGS. 62 to 64) relating to the top discharge fluid engine.

Claim 8 clarifies the original claim 7 filed.

Claim 9 clarifies the original claim 4 filed and is associated with the Best Modes 8 and 9 for Carrying Out the Invention (FIGS. 58 to 61) relating to the subsidiary chamber type thin internal combustion engine.

Claim 10 is identical to the original claim 8 filed and is associated with the Best Mode 11 for Carrying Out the Invention (FIG. 65) relating to the cylinder-crank connection type engine.

What is claimed is:

1. An engine, having a valve device, said engine having a cylinder into which a fluid is supplied, a piston mounted in said cylinder, and a valve for providing switching between suction and exhaust of a pressure fluid to and from said cylinder, said valve device comprising:

a valve seat defined by an opening for fluid inflow formed in an end face of said cylinder, said opening being smaller in area than an end face of said piston; and a valve disc arranged outside of said valve seat, said valve disc coming into abutment against said valve seat, wherein said cylinder is movable in its axial direction, said end face of said cylinder being capable of coming into or out of contact with said valve disc, wherein when an interior of said cylinder is pressurized as a result of abutment of said valve seat against said valve disc, said end face of said cylinder is urged toward said valve disc so that said valve seat and said valve disc are brought into press-contact with each other, wherein movement of said cylinder is controlled by movement of said piston, wherein said cylinder includes an upper cylinder and a lower cylinder, said upper cylinder being urged downward, said lower cylinder being urged upward, and said lower cylinder having a lower end at which it has a raised portion against which a lower end of said piston abuts, wherein when said piston rises, said lower cylinder also rises and thrusts up said upper cylinder to close said valve seat so that said valve seat comes into press-contact with said valve disc when the interior of said cylinder is pressurized, and wherein when said piston falls, said lower cylinder is disengaged from said upper cylinder so that an outlet is formed between said upper cylinder and said lower cylinder and that said valve seat is opened to form an opening.

2. An engine, having a valve device, the valve device comprising a cylinder into which a fluid is supplied, a piston mounted in said cylinder, and a valve for providing switching between suction and exhaust of a pressure fluid to and from said cylinder, said valve device comprising:

a valve seat defined by an opening for fluid inflow formed in an end face of said cylinder, said opening being smaller in area than an end face of said piston; and a valve disc arranged outside of said valve seat, said valve disc coming into abutment against said valve seat, wherein said cylinder is movable in its axial direction, said end face of said cylinder being capable of coming into or out of contact with said valve disc, wherein when an interior of said cylinder is pressurized as a result of abutment of said valve seat against said valve disc, said end face of said cylinder is urged toward said valve disc so that said valve seat and said valve disc are brought into press-contact with each other, wherein movement of said cylinder is controlled by movement of said piston, wherein above said cylinder are formed an inlet and an outlet, said inlet and said outlet each having a check valve, wherein said piston is urged upward by a piston spring, wherein said cylinder is urged upward by a cylinder spring, wherein said cylinder is provided at its lower end with a lock pin capable of being engaged with or disengaged from said cylinder for locking or unlocking said cylinder, said lock pin being controlled by an interlocking mechanism so as to come into or out of contact with said cylinder depending on rotation of a crank, wherein said check valve of said outlet above said cylinder is opened for exhaust when said piston rises with said lock pin engaged with said cylinder, said check valve of said inlet being opened for introduction of new air when said piston falls with said lock pin engaged with said cylinder, and wherein combustion gas is emitted from said outlet above said cylinder when said piston falls with said lock pin disengaged from said cylinder.

3. An engine, having a valve device, the valve device comprising a cylinder into which a fluid is supplied, a piston mounted in said cylinder, and a valve for providing switching between suction and exhaust of a pressure fluid to and from said cylinder, said valve device comprising:

a valve seat defined by an opening for fluid inflow formed in an end face of said cylinder, said opening being smaller in area than an end face of said piston; and a valve disc arranged outside of said valve seat, said valve disc coming into abutment against said valve seat, wherein said cylinder is movable in its axial direction, said end face of said cylinder being capable of coming into or out of contact with said valve disc, wherein when an interior of said cylinder is pressurized as a result of abutment of said valve seat against said valve disc, said end face of said cylinder is urged toward said valve disc so that said valve seat and said valve disc are brought into press-contact with each other, wherein movement of said cylinder is controlled by movement of said piston, wherein said cylinder is urged upward by a cylinder spring, said cylinder having a lower end at which it has a raised portion against which a lower end of said piston abuts, wherein a rotary valve is disposed between an inlet and an outlet above said cylinder, and wherein said rotary valve acts to provide a control such that both said inlet and said outlet are closed when said piston is at or in vicinity of its bottom dead center in a first cycle, said outlet being opened when said piston rises, said inlet being opened when said piston falls, and such that both said inlet and said outlet are closed all the time in a second cycle so that gas is emitted from an opening of said cylinder when said piston falls after ignition.

4. An engine, having a valve device, the valve device comprising a cylinder into which a fluid is supplied, a piston mounted in said cylinder, and a valve for providing switching between suction and exhaust of a pressure fluid to and from said cylinder, said valve device comprising:

a valve seat defined by an opening for fluid inflow formed in an end face of said cylinder, said opening being smaller in area than an end face of said piston; and a valve disc arranged outside of said valve seat, said valve disc coming into abutment against said valve seat, wherein said cylinder is movable in its axial direction, said end face of said cylinder being capable of coming into or out of contact with said valve disc, wherein when an interior of said cylinder is pressurized as a result of abutment of said valve seat against said valve disc, said end face of said cylinder is urged toward said valve disc so that said valve seat and said valve disc are brought into press-contact with each other, wherein movement of said cylinder is controlled by movement of said piston, wherein above said cylinder are formed an inlet and an outlet, said inlet and said outlet each having a check valve, with an outlet for combustion gas being disposed below said outlet, said outlet for combustion gas being provided with a switching valve having an annular disc, wherein said switching valve is freely capable of rising and falling and is urged downward by a valve spring so as to come into abutment against an upper end of said cylinder, said switching valve closing said outlet for combustion gas when said switching valve falls, and said switching valve closing said outlet above said cylinder when said switching valve rises, wherein said cylinder is provided with a lock pin capable of being engaged with or disengaged from said cylinder for locking or unlocking said cylinder, wherein in a first cycle, said cylinder is locked at its lower position by said lock pin, with said switching valve being pressed downward to close said outlet for combustion gas, and wherein in a second cycle, said cylinder is released from locking by said lock pin, with said switching valve being thrust upward by the pressure of the combustion gas when said piston falls after ignition so that said outlet for combustion gas is opened to emit combustion gas therethrough.

5. An engine, having a valve device, the valve device comprising a cylinder into which a fluid is supplied, a piston mounted in said cylinder, and a valve for providing switching between suction and exhaust of a pressure fluid to and from said cylinder, said valve device comprising:

a valve seat defined by an opening for fluid inflow formed in an end face of said cylinder, said opening being smaller in area than an end face of said piston; and a valve disc arranged outside of said valve seat, said valve disc coming into abutment against said valve seat, wherein said cylinder is movable in its axial direction, said end face of said cylinder being capable of coming into or out of contact with said valve disc, wherein when an interior of said cylinder is pressurized as a result of abutment of said valve seat against said valve disc, said end face of said cylinder is urged toward said valve disc so that said valve seat and said valve disc are brought into press-contact with each other, wherein movement of said cylinder is controlled by movement of said piston, wherein above said cylinder are formed an inlet and an outlet, wherein said outlet is positioned such that said outlet is closed by said cylinder when said cylinder rises and that said outlet is opened when said cylinder falls, wherein an intermediate valve is disposed in such a manner as to be able to freely rise and fall between said cylinder and said valve disc, said intermediate valve having a bottom face coming into abutment against said valve seat of said cylinder and having a top face coming into abutment against said valve disc, said intermediate valve being urged downward by a valve spring, wherein when said piston is at its bottom dead center, an inlet flow passage is formed between the top face of said intermediate valve and said valve disc whilst an outlet flow passage is formed between said intermediate valve and said valve seat so that the interior of said cylinder is scavenged, wherein when said piston rises, said cylinder rises together with the rise of said piston and said intermediate valve comes into abutment against said valve seat to shut off fluid communication between a cylinder opening and said outlet to allow only inflow to continue, wherein when said cylinder further rises, said intermediate valve comes into abutment against said valve disc to close said cylinder opening, and wherein when said piston falls after combustion, said intermediate valve is thrust up by pressure of combustion gas and said outlet flow passage is opened to emit combustion gas therethrough.

6. An engine, having a valve device, the valve device comprising a cylinder into which a fluid is supplied, a piston mounted in said cylinder, and a valve for providing switching between suction and exhaust of a pressure fluid to and from said cylinder, said valve device comprising:

a valve seat defined by an opening for fluid inflow formed in an end face of said cylinder, said opening being smaller in area than an end face of said piston; and a valve disc arranged outside of said valve seat, wherein an auxiliary valve disc is disposed in such a manner as to be able to freely rise and fall between an upper end face of said cylinder and said valve disc, wherein said cylinder is movable in its axial direction, with said end face of said cylinder being capable of coming into or out of contact with said auxiliary valve disc, wherein when an interior of said cylinder is pressurized as a result of abutment of said auxiliary valve disc against said valve seat and said valve disc, said end face of said cylinder is urged toward said valve disc so that said auxiliary valve disc is brought into press-contact with said valve seat and said valve disc, wherein movement of said cylinder is controlled by movement of said piston, wherein an auxiliary valve body is disposed in such a manner as to be able to freely rise and fall between said cylinder and said valve disc, wherein a body of the engine is provided with a seat for said auxiliary valve seat, wherein an inlet passage for thick gas mixture is disposed above said auxiliary valve disc, with an inlet passage for thin gas mixture being disposed below said auxiliary valve disc, wherein said auxiliary valve disc is provided with a vent for allowing said inlet passage for thick gas mixture to fluidly communicate with a cylinder opening, and wherein as a result of rise of said cylinder, said valve seat of said cylinder comes into abutment against and thrusts up said auxiliary valve disc so that a top face of said auxiliary valve disc is abutted against said valve disc so that said cylinder opening is closed to hermetically seal the interior of said cylinder.

7. An engine, having a valve device, according to any one of claims 1 to 6, wherein said valve disc is provided with a fuel injection nozzle.

8. An engine, having a valve device, according to any one of claims 1 to 6, wherein said valve disc is provided with an igniter.

9. An engine, having a valve device, according to any one of claims 1 to 6, wherein said valve disc is provided with a fuel injection nozzle and an igniter.

10. An engine, having a valve device, according to any one of claims 1 to 5, wherein said cylinder is urged toward said valve disc, said cylinder being provided at its lower portion with a raised portion against which a lower end of said piston abuts, with a lower side wall of said cylinder having an outlet which opens when said piston falls, wherein between said piston and a lower portion of said cylinder is disposed a piston spring for urging said piston upward so that said piston closes said outlet when said piston spring has been fully extended, and wherein when an interior of said cylinder is pressurized as a result of rise of said piston, said valve seat comes into press-contact with said valve disc, whilst when said piston falls, said outlet is opened and said cylinder falls as a result of pressing by said piston so that said valve seat is disengaged from said valve disc.

11. An engine, having a valve device, the valve device comprising a cylinder into which a fluid is supplied, a piston mounted in said cylinder, and a valve for providing switching between suction and exhaust of a pressure fluid to and from said cylinder, said valve device comprising:

a valve seat defined by an opening for fluid inflow formed in an end face of said cylinder, said opening being smaller in area than an end face of said piston; and a valve disc arranged outside of said valve seat, said valve disc coming into abutment against said valve seat, wherein said cylinder is movable in its axial direction, said end face of said cylinder being capable of coming into or out of contact with said valve disc, wherein when an interior of said cylinder is pressurized as a result of abutment of said valve seat against said valve disc, said end face of said cylinder is urged toward said valve disc so that said valve seat and said valve disc are brought into press-contact with each other, wherein movement of said cylinder is controlled by movement of said piston, wherein a cap of a body of the engine includes an inlet for pressure fluid, with between said inlet for pressure fluid and said valve seat of said cylinder there being provided, in such a manner as to be able to rise and fall, a valve disc for opening and closing a cylinder opening and a spherical auxiliary valve disc moving in conjugation with movement of said valve disc for opening and closing said inlet, wherein said cylinder and said valve disc are urged downward by respective springs, wherein said valve disc is provided with a communication passage for providing a communication between upper and lower portions so that when said valve disc rises, said auxiliary valve disc is thrust up by a protrusion to open said valve, wherein when said cylinder falls, said cylinder opening is opened to exhaust the interior of said cylinder of fluid whilst said valve seat at said inlet for pressure fluid is closed by said auxiliary valve disc, and wherein when said valve seat of said cylinder abuts against said valve disc, said opening is closed and said auxiliary valve disc is thrust up by said protrusion to open said inlet for pressure fluid so that said pressure fluid flows through said communication passage of said valve disc into the interior of said cylinder so that said piston is pressed down.

12. An engine, having a valve device, the valve device comprising a cylinder into which a fluid is supplied, a piston mounted in said cylinder, and a valve for providing switching between suction and exhaust of a pressure fluid to and from said cylinder, said valve device comprising:

a valve seat defined by an opening for fluid inflow formed in an end face of said cylinder, said opening being smaller in area than an end face of said piston; and a valve disc arranged outside of said valve seat, said valve disc coming into abutment against said valve seat, wherein said cylinder is movable in its axial direction, said end face of said cylinder being capable of coming into or out of contact with said valve disc, wherein when an interior of said cylinder is pressurized as a result of abutment of said valve seat against said valve disc, said end face of said cylinder is urged toward said valve disc so that said valve seat and said valve disc are brought into press-contact with each other, wherein movement of said cylinder is controlled by movement of said piston, wherein a pump chamber is formed between an inner wall of an engine body and an outer wall of said cylinder capable of freely rising and falling, by differentiating in diameter the upper portion from the lower portion of said inner wall of said engine body via a shoulder and by differentiating in diameter an upper portion from a lower portion of said outer wall of said cylinder via a shoulder, wherein said pump chamber is placed in communication with a heater and a cooler, said heater leading to the upper portion of said cylinder, wherein between said inlet to said cylinder of said heater and said cylinder is disposed a valve disc for opening and closing a flow passage extending between said inlet and said cylinder by rise and fall of said piston, wherein said valve disc formed in the shape of a tube with its upper portion having an opening which leads to said inlet, said valve disc being urged downward, wherein when said piston is at its top dead center, said valve disc is thrust up to allow said inlet and said valve disc opening to communicate with each other to open said flow passage whilst said valve disk opening and said outlet are closed to allow heated fluid to flow into said cylinder so that said piston is pressed down with said cylinder falling, and wherein when said cylinder falls, communication between said inlet and said cylinder is shut off and said cylinder is placed in communication with said cooler by way of said outlet whilst said pump chamber is reduced in volume to allow fluid within said pump chamber to flow into said heater.

13. An engine, having a valve device, the valve device comprising a cylinder into which a fluid is supplied, a piston mounted in said cylinder, and a valve for providing switching between suction and exhaust of a pressure fluid to and from said cylinder, said valve device comprising:

a valve seat defined by an opening for fluid inflow formed in an end face of said cylinder, said opening being smaller in area than an end face of said piston; and a valve disc arranged outside of said valve seat, said valve disc coming into abutment against said valve seat, wherein said cylinder is movable in its axial direction, said end face of said cylinder being capable of coming into or out of contact with said valve disc, wherein when an interior of said cylinder is pressurized as a result of abutment of said valve seat against said valve disc, said end face of said cylinder is urged toward said valve disc so that said valve seat and said valve disc are brought into press-contact with each other, wherein movement of said cylinder is controlled by movement of said piston, wherein said cylinder comprises a cylinder body formed in the shape of a tube, and a cylinder end face element having an opening and a valve seat, said cylinder end face element being fitted to an upper end of said cylinder body in such a manner as to be able to rise and fall, wherein said cylinder body is firmly secured to a body of the engine, with said cylinder end face element being fitted to said cylinder body in an air-tight manner, said cylinder end face element being coupled to an actuator via a rod, and wherein said actuator is urged upward by a spring so that when said piston falls, said actuator falls as a result of pressing of said piston and that when said piston rises, said actuator rises by a biasing force of said spring.

* * * * *